US006981913B2

(12) United States Patent
Shirasawa et al.

(10) Patent No.: US 6,981,913 B2
(45) Date of Patent: Jan. 3, 2006

(54) GAMING TOKEN PAYOUT APPARATUS

(75) Inventors: Masaharu Shirasawa, Tokyo (JP); Yoshikazu Tomioka, Tokyo (JP)

(73) Assignee: Konami Corporation, Tokyo (JP)

( * ) Notice: Subject to any disclaimer, the term of this patent is extended or adjusted under 35 U.S.C. 154(b) by 0 days.

(21) Appl. No.: 10/136,384

(22) Filed: May 2, 2002

(65) Prior Publication Data

US 2003/0057644 A1 Mar. 27, 2003

(30) Foreign Application Priority Data

May 2, 2001 (JP) ..... P.2001-135162
Jan. 31, 2002 (JP) ..... P.2002-024466
Mar. 27, 2002 (JP) ..... P.2002-088803

(51) Int. Cl.
*G07D 1/00* (2006.01)

(52) U.S. Cl. ..... 453/33; 453/10; 453/12; 453/13; 453/49; 453/57

(58) Field of Classification Search ..... 453/6, 453/8, 10–13, 15, 22, 32–36, 42, 49, 57
See application file for complete search history.

(56) References Cited

U.S. PATENT DOCUMENTS 3,415,256 A * 12/1968 Meloni ..... 453/41
4,586,522 A * 5/1986 Taipale et al. ..... 453/10
5,624,308 A * 4/1997 Rumbach ..... 453/3
6,099,402 A * 8/2000 Abe et al. ..... 453/57

FOREIGN PATENT DOCUMENTS

JP 2000-107354 4/2000

* cited by examiner

*Primary Examiner*—Donald P. Walsh
*Assistant Examiner*—Jeffrey Shapiro
(74) *Attorney, Agent, or Firm*—Sughrue Mion, PLLC

(57) ABSTRACT

A cylindrical body is rotated about a rotation axis interconnecting a center point of a top circle thereof and a center point of a bottom circle thereof. The cylindrical body having an outer peripheral face formed with at least one token-groove. An outer wall member covers the outer peripheral face of the cylindrical body to form a gap between an inner face of the outer wall member and the token-groove such that a single gaming token in an upright attitude is held therein. The gaming token held in the gap is ejected toward a tangent direction of an outer peripheral circle of the cylindrical body in accordance with a rotary action of the cylindrical body.

32 Claims, 18 Drawing Sheets

GAMING TOKEN PAYOUT APPARATUS

BACKGROUND OF THE INVENTION

The present invention relates to a gaming machine, such as a slot machine or a game machine, or to an amusement machine (hereinafter sometimes also called a "gaming machine"). Particularly, the invention relates to a technique which is effective when applied to a gaming token payout apparatus capable of dispensing a gaming token (hereinafter sometimes also called a "coin") to an elevated position relative to a storage section, wherein mechanical resistance, such as mechanical sliding or clogging occurring at the time of a gaming token payout operation, can be reduced, and wherein a mechanism for transporting a gaming token to an elevated position can be made compact.

In a gaming machine using gaming tokens, a gaming value is usually embodied by a gaming token. Insertion of a gaming token enables a player to play a game or pastime (hereinafter simply called "game"). When the player has won a game or is awarded a group of winnings as a result of play, gaming tokens are returned to the player. For this reason, the gaming machine is equipped with a gaming token payout apparatus for dispensing gaming tokens to the player. A gaming machine on which a player plays a game through use of gaming tokens, such as a slot machine, is equipped with a built-in gaming token payout apparatus. Particularly, a slot machine pays out gaming tokens when symbols on reels have constituted a certain combination (e.g., 7-7-7 or the like).

Here, an expression "gaming value" means a value to be obtained by a player. For instance, if a specific combination of symbols (i.e., a winning hand) has been constituted on a slot machine or a like machine, the player is awarded a win. When a winning has been achieved, the machine pays out gaming tokens or the like (i.e., gaming values) corresponding to a prize for the winning. The term "game" usually denotes licensed business entertainment. However, throughout the specification, the term "game" also implies global entertainment.

Functions required of the gaming token payout apparatus include the function of reserving gaming tokens, the function of dispensing gaming tokens while counting reserved gaming tokens, and the function of reporting a full state of the reserved gaming tokens. The function of counting gaming tokens is implemented by a sensor disposed at a gaming token payout port. Gaming tokens are paid out from reserved gaming tokens by action of a gaming token payout mechanism while an output from the sensor is being monitored. The payout mechanism is controlled so as to cease operating after payout of a predetermined number of gaming tokens has been completed.

A gaming token payout apparatus which places importance on the counting function generally adopts the following mechanism as a payout mechanism. Specifically, a turntable is disposed at the bottom of a gaming token bucket for reserving gaming tokens, and gaming tokens are paid out by rotation of the turntable. A plurality of holes are usually formed in the turntable such that their centers are arranged along a circle that is concentric with the center of rotation of the turntable, wherein each hole is of a size sufficient to enable entry of one gaming token. The turntable is rotated by a motor through an angle corresponding to one hole. The gaming token held in the hole is separated from the hole by a stationary separation mechanism disposed below the turntable. The gaming token that has been separated from the hole by rotating force is ejected to the payout port. Since the turntable is usually disposed horizontally or at a slight angle from the horizontal, the gaming token is ejected horizontally or at the slight angle. In consideration that a gaming token is dropped under the force of gravity into the hole formed in the turntable, common sense dictates that the angle of inclination of the turntable with respect to a horizontal plane cannot be made excessively large.

The gaming token payout apparatus is usually disposed at the bottom of the gaming machine. Since a gaming token inserted by way of an insertion slot falls into the storage section under the force of gravity, the storage section must be situated in at least a position lower than the insertion slot. Further, in consideration that a large volume of gaming tokens can be reserved, the total weight of the gaming token payout machine becomes considerably large. In view of assurance of safety of the gaming machine, the payout apparatus is preferably situated in a low position. For this reason, a gaming token is paid out to a lower part of the gaming token payout apparatus; that is, a gaming token receiver disposed in a lower part of the gaming machine, unless there is provided a mechanism for transporting gaming tokens upward to the gaming token payout port.

A gaming machine having a receiver in a lower part thereof does not always offer a comfortable gaming environment to a player who plays on such a gaming machine. Gaming tokens which are paid out from the gaming machine are reserved in the receiver disposed at a lower part of the gaming machine. When inserting gaming tokens during the course of a game, the player must take gaming tokens out of the receiver and carry the tokens to the insertion slot. These actions involve transportation of gaming tokens from a lower position to a higher position, and manually transporting the gaming tokens is bothersome for the player. If a distance over which gaming tokens must be transported is long, the player becomes more likely to drop gaming tokens during transportation or to inadvertently leave some of gaming tokens in the receiver. Leaving gaming tokens in the receiver or dropping gaming tokens during the course of a game greatly spoils the entertainment value of the game, causing some players to feel irritated.

For these reasons, the gaming token receiver is preferably disposed in close proximity to the insertion slot; if possible, at the same position as the insertion slot, or at a position slightly lower than the insertion slot. If the receiver and the insertion slot are situated in such a positional relationship, insertion of a gaming token is facilitated, thereby decreasing the possibility of the gaming tokens being dropped or left. Thus, the entertainment value of the game is not deteriorated, and the player's feeling of irritation can be prevented.

On the premise that the gaming token payout apparatus is disposed at a lower part of the gaming machine, the gaming token receiver is disposed at the same position as that of the insertion slot or at a position slightly lower than the insertion slot. Hence, the gaming machine must be equipped with a mechanism for transporting gaming tokens ejected from the gaming token payout apparatus to a higher position.

FIG. 21 shows an example of a gaming token payout apparatus having such a gaming token transport mechanism. FIG. 21 is a descriptive view showing an example of a related-art gaming token payout apparatus and the manner in which gaming tokens are paid. The gaming token payout apparatus shown in FIG. 21 comprises a bucket 311; a turntable 313; a motor 315; and an escalator rail 317. Gaming tokens inserted from an elevated position are stored (reserved) in the bucket 311. Holes for arranging gaming tokens in a concentric arrangement are formed in the turntable 313, and one gaming token is pushed to the escalator rail 317 by rotation of the turntable 313 through an angle corresponding to one hole. The motor 315 imparts torque to the turntable 313, and the escalator rail 317 transports the gaming token upward by pushing force exerted by the turntable 313. The related-art gaming token payout apparatus comprises the bucket 311 for storing gaming tokens; the turntable 313 for paying out, one at a time, the gaming tokens stored in the bucket 311; and the motor 315 for rotating the turntable 313. The gaming token payout apparatus is further provided with the escalator rail 317, which advances the gaming token paid from the turntable 313 when the token is transported upward. The gaming token payout apparatus is usually disposed in a lower part of the gaming machine and is connected to a gaming token tray (not shown) disposed at a comparatively high position on the gaming machine. In relation to the majority of the related-art gaming token payout apparatus, the turntable 313 and the motor 315 are disposed at angles with respect to a horizontal direction. Although the upper end of the escalator rail 317 is connected to the gaming token receiver, detailed illustration of the upper end is omitted.

As illustrated, the turntable 313 is disposed with an inclination with respect to a horizontal plane. A gaming token is pushed in parallel with the thus-inclined plane (i.e., a rotating face of the turntable 313). Hence, the portion of the escalator rail 317 connected to the turntable 313 is substantially parallel with the inclined plane. If an attempt is made to straighten the escalator 317 so as to make it substantially perpendicular, the connected portion acquires a bend 319, as illustrated. When the turntable 313 is rotated as a result of driving of the motor 315, the gaming tokens stored in the gaming toke bucket 311 are paid one at a time by way of a payout port (not shown). At this time, the gaming token is paid in parallel with the turntable 313 and advances through the inside of the escalator rail 317 so as to be pushed by a subsequently-paid gaming token.

However, in the case of the apparatus shown in FIG. 21, the bend 319 of the escalator rail 317 constitutes a curve that departs from a plane parallel with the front and back sides of a gaming token. Such a curve may pose a problem of an increase in sliding resistance stemming from transportation of gaming tokens. A conceivable way to reduce sliding resistance is to increase the thickness of a cross section of a transport pathway formed within the escalator rail 317 so as to become larger than the thickness of a gaming token. However, if the cross section of the transport pathway is increased excessively, the gaming tokens mesh with each other, thus increasing the risk of hindrance to smooth transportation. If an attempt is made to reduce sliding resistance without increasing the cross section of the transport pathway, the radius of curvature of the bend 319 must be increased. However, an increase in the radius of curvature of the bend 319 results in an increase in spatial capacity required for setting the escalator rail 317. Thus, there arises another problem of the gaming token payout apparatus becoming bulky.

Moreover, in the related-art gaming token payout apparatus, the turntable 313 and the motor 315 are oriented at a slight angle from the horizontal. However, orienting the turntable 313 and the motor 315 at such a slight angle leads to a problem of reducing an effectively available space in the gaming machine.

Another example of a gaming token payout apparatus having a mechanism for transporting gaming tokens upward is a coin payout apparatus for use in a gaming machine as described in Japanese Patent Publication No. 2000-107354A. In relation to the apparatus described in the patent application, gaming tokens are sent from a bucket section by an ejection mechanism analogous to the turntable 313 shown in FIG. 21. A delivery section is provided with means for changing the inclination of the coins. The means for changing the inclination of the coin draws the coin that has been sent in an inclined position into a gap between a pair of rollers to be rotatably driven. By action of a spring or the like, a force for reducing the interval between the rollers is exerted on the rollers, thereby changing the orientation of the coin to a vertical direction. The coin that has been changed in position with respect to a vertical direction (i.e., a coin in an upright position) is pushed into a lower part of the escalator section while remaining in an upright position; whereby the coin is transported to a higher position within the escalator section. By such a coin payout apparatus for a gaming machine, the coin is pushed into the escalator section while remaining in an upright position. Hence, even in an area where the coin is transported in a horizontal orientation to a vertical orientation, the coin still remains rotatable within the escalator section. Therefore, the orientation and direction of a coin are changed smoothly. Therefore, it is said that smooth transportation of coins can be performed with through elimination of clogging of coins.

According to the latter coin payout apparatus for use with a gaming machine, a coin is transported to the escalator section while remaining in an upright position. Hence, there arises no problem of sliding resistance developing in the escalator section or an increase in the layout space of the escalator section. However, means for changing the inclination of a coin, which also acts as a mechanism for bringing the coin into an upright position, is a complicated mechanism. Further, acting force of a spring or that of a like element must be optimally adjusted such that a coin having been sent while remaining in an inclined attitude is drawn between a pair of rollers without fail. In a transient phase from the time the coin has been drawn into a space between rollers until the orientation of the coin is changed to the vertical, the space between the rollers opens up considerably, and rotary shafts of the rollers must be moved so as to return the rollers to their original positions. Further, the force required for pushing a coin to the escalator section must be imparted by the torque of the rollers. Hence, frictional resistance arising between the rollers and the coin must be set to a considerably large value. Frictional resistance is generated by acting force of a spring or a like element, which closes the space between the rollers. For this reason, there is no other choice but to effect delicate adjustment between the acting force for closing the space and the acting force for opening up the space between the rollers at the time of drawing of a coin. In short, delicate adjustment between the acting forces and its maintenance are required. A conceivable measure for increasing frictional resistance between the rollers and a coin while reducing the acting force for closing the space between the rollers is to use resin such as rubber as material of the rollers (at least as material of the faces of the rollers). However, such a material for increasing frictional resistance usually exhibits poor durability. Therefore, there still arises a problem of low maintainability.

Any one of the related-art apparatuses described above involves a problem of the turntable 313 (or a corresponding member described in the latter apparatus) being disposed at a slight angle from the horizontal. In the case of the latter apparatus, when a gaming token has been ejected horizontally, the pair of rollers encounters difficulty in changing the inclination of the gaming token, in light of the principle. In the apparatus shown in FIG. 21, the turntable 313 can in principle be disposed in a horizontal position. However, as a result of this, the foregoing problem arises in a more prominent manner. For these reasons, any of the pieces of the apparatus are considered to deliver a gaming token in an inclining direction.

The gaming token falls under the force of gravity into a hole formed in the turntable. When the turntable is disposed at a slight angle from the horizontal, there may arise a case where an area located in a diagonally higher position relative to the turntable is not filled with reserved gaming tokens. In such a case, occasions for gaming tokens falling into the holes of the turntable are diminished. Gaming tokens are expected to fall into the holes formed in the turntable by themselves. In some rare cases, a gaming token may fail to fall into a hole. Against this backdrop, it is preferable to create a situation in which the entire turntable is exposed to gaming tokens. Such a situation can be realized by placing a turntable in a horizontal orientation. In the first place, placing the turntable at a slight angle to the horizontal is not preferable, because difficulty is encountered in causing reserved gaming tokens to fall into the holes of the turntable under the force of gravity.

SUMMARY OF THE INVENTION

The object of the invention is to provide a gaming token payout apparatus capable of effectively inhibiting clogging of gaming tokens. Another object of the invention is to provide a gaming token payout apparatus capable of smoothly and surely ejecting gaming tokens. Yet another object of the invention is to provide sufficient pushing force which ejects a gaming token while remaining in a vertical orientation. Still another object of the invention is to provide a gaming token payout apparatus which is capable of minimizing a horizontal distance of transportation even when the apparatus is equipped with a transport mechanism for transporting gaming tokens upward and which enables a reduction in layout space.

The problems involved the gaming token payout apparatus are not limited particularly to a gaming machine, but arise commonly in other equipment utilizing a gaming tokens (or coins), such as a vending machine. The invention described herein is not limited to solely gaming machines, but is also applicable to more general equipment that utilize gaming tokens.

Before explanation of the configuration and others of the invention, a coordinate system and terms employed herein will first be described. Unless explicit given other definitions, the terms employed herein in principle imply the following definitions.

When a coordinate system is used herein, the coordinate system is in principle represented as a rectangular coordinate system. Three coordinate axes crossing at right angles are represented as the X axis, the Y axis, and the Z axis. The orientation of the Z axis is defined in an orientation of a vector product of unit vectors of the X and Y axes. The X axis extends in the orientation of its unit vector, and the Y axis also extends in the orientation of its unit vector. Coordinates of an arbitrary point P are represented as (x, y, z). When an explanation is given of a cylindrical or columnar member, a polar coordinate system may be employed in addition to the rectangular coordinate system. When a polar coordinate system is used herein, the center of a bottom circle of a column or cylinder is taken as a point of origin, and a radius vector "r" is set within a plane including a bottom circle. Provided that a rotation angle of "r" is taken as $\theta$ and the height of "r" is taken as "h," coordinates of an arbitrary point P are represented as $(r, \theta, h)$. When the polar coordinate system is associated with the rectangular coordinate system, a reference line is set on the X axis. Further, an angle formed between the X axis and the radius vector "r" is taken as $\theta$, and the height of the radius vector "r" is taken as "z." An arbitrary point P represented as (x, y, z) in the rectangular coordinate system is represented as $(r \cdot \cos\theta, r \cdot \sin\theta, z)$ in terms of the polar coordinate system.

Here, the term "vertical direction" designates an orientation parallel with a gravitational acceleration vector. The negative direction of the Z axis is taken as the direction of a gravitational acceleration vector. Therefore, the vertical direction is parallel with the Z axis. The positive direction of the Z axis may be called "upward," and the negative direction of the Z axis may be called "downward." Here, the term "horizontal plane" designates a plane parallel with a plane including the X and Y axes (i.e., the x-y plane). Here, the term "horizontal direction" designates the direction of an arbitrary vector within the horizontal plane.

The expression stating that "a gaming token is oriented horizontally" implies that a disk face (i.e., obviate or reverse face) of a disk-shaped gaming token lies in a horizontal plane or substantially in the same. Here, the expression "substantially in a horizontal plane" means a state in which an inclination (an inclination with respect to the horizontal plane) exists in the disk face of the gaming token to such an extent that the inclination does not differ from a case where physical behavior of the gaming token takes place within the horizontal plane. For instance, if movement of a gaming token stemming from collision or friction with another gaming token or a member or from another action is not different from a case where movement of a gaming token takes place within a horizontal plane, the gaming token is considered to be in a substantially horizontal plane even if in the strict sense the gaming token is not within the horizontal plane (e.g., the gaming token deviates from the horizontal plane). Although a member for retaining gaming tokens should originally retain gaming tokens horizontally, even when gaming tokens deviate from a horizontal plane for reasons of mechanical errors or a deviation of the member from the horizontal plane when the member is mounted, the gaming tokens are considered to be substantially horizontal.

The expression "a gaming token is in an upright position" implies that a normal line perpendicular to the disk face (i.e., the obviate or reverse face) of the disk-shaped gaming token lies in a horizontal plane or substantially in a horizontal plane; namely, that the disk face of the disk-shaped gaming token is orthogonal to or substantially orthogonal to the horizontal plane. The term "substantially orthogonal" or the expression stating that "a gaming token is substantially orthogonal" refers to a state in which an inclination (i.e., a deviation from a direction orthogonal to the horizontal plane) exists in the disk face of the gaming token to such an extent that the inclination does not differ from a case where the physical behavior of the gaming token is in an upright state. For instance, if movement of a gaming token stemming from collision or friction with another gaming token or a member or from other action does not deviate from an upright state, the gaming token is considered to be in a substantially upright state even if in the strict sense the gaming token is not in an upright position. Although a member for retaining gaming tokens should originally retain gaming tokens in an upright state, even when gaming tokens deviate from an upright position for reasons of mechanical error or a deviation of the member from the vertical plane when the member is mounted, the gaming tokens are considered to be oriented substantially upright. Moreover, even when gaming tokens are slightly inclined within a retaining member for reasons of presence of a large margin between the member for retaining gaming tokens in an upright position and gaming tokens, the gaming tokens are considered to be oriented substantially upright. Here, the term "upright" is often replaced with the term "vertical/perpendicular."

In some cases, the term "cylinder" and the term "column" are used in the same meaning. Herein, a three-dimensional member having a hollow columnar portion provided around and concentric with the axis of rotation (i.e., a three-dimensional cylindrical member) is particularly expressed by the term "cylinder." Here, the "cylindrical member" is a three-dimensional member having an upper face, a bottom face, an outer peripheral face, and an inner circumferential face. When a cylindrical shape is expressed in the coordinate system, a "bottom face" of the cylindrical member is included in an x-y plane of z=0; and an "upper face" of the same is included in an x-y plane of z=h ("h" designates the height of the cylindrical shape). The outer periphery of the bottom or upper face of the cylindrical member corresponds to a "bottom face outer peripheral circle" or an "upper face outer peripheral circle." The center point of the bottom/upper face outer peripheral circle falls on the Z axis. The inner periphery of the bottom or upper face of the cylindrical member corresponds to a "bottom face inner peripheral circle" or an "upper face inner peripheral circle." The center point of the bottom/top face inner peripheral circle is included in the Z axis. The inner peripheral circle of the upper face of the cylindrical member is sometimes called an "inner periphery of the upper face," and the outer peripheral circle of the upper face is sometimes called an "outer periphery of the upper face." The "axis of rotation" of the cylindrical member lies along the Z axis. The "outer peripheral face" of the cylindrical member is a curved face defined by a locus delineated by a bottom face outer peripheral circle when the bottom face outer peripheral circle is moved in the Z direction within the range of z=0 to z=h. An "outer periphery" of the cylindrical member is an arbitrary point belonging to an outer peripheral face. An "outer peripheral circle" of the cylindrical member is an arbitrary circle parallel to the bottom face (upper face) included in the outer peripheral face. An "inner peripheral face" of the cylindrical member is a curved face defined by a locus delineated by a bottom face inner peripheral circle when the bottom face inner peripheral circle is moved in the Z direction within the range of z=0 to z=h.

The "upper face," "bottom face," "outer peripheral face," and "inner circumferential face" of the cylindrical member are defined as mentioned previously. Throughout the specification, a plane, a curved face, or a combination thereof which impart a real outer shape to a member are generically called an "upper face," an "outer peripheral face," or the like. For instance, if indentations, grooves, holes, projections, or the like are formed in the outer peripheral face of upper face of the cylindrical member, strictly speaking, the face including the indentations or the like is not encompassed by the definition of the upper face or that of the outer peripheral face. Here, so long as indentations or the like are formed such that their portions are associated with an upper face or an outer peripheral face, an upper face of outer peripheral face including the indentations is encompassed by the definition of the upper face or that of the outer peripheral face. For instance, when a groove is said to be formed in an outer circumferential section of a cylindrical member, a more precise description is that a face corresponding to an outer peripheral face of that cylindrical member is constituted of a cylindrical outer peripheral face of a non-grooved portion, and side faces and bottom face of the groove (i.e., interior faces of the groove). The face constituted of the outer peripheral face and the faces of the groove is also considered to be an "outer peripheral face." The same principle also applies to members having geometries other than a cylindrical shape.

The definitions related to the cylindrical member also apply to a "columnar member," except for portions relevant to an inner periphery. The term "obviate face (or reverse face) of a gaming token" designates a disk face of a disk-shaped gaming token. The term "side face of a gaming token" designates an outer peripheral face of the disk-shaped gaming token.

In order to achieve the above objects, according to the present invention, there is provided a gaming token payout apparatus comprising a columnar or cylindrical body; an outer wall member; token-grooves formed in an outer peripheral face of the columnar or cylindrical body; receiving sections formed in an upper face of the columnar or cylindrical body; guide plates having first holes; and a disk plate having second holes. In association with rotation of the columnar or cylindrical body, the first holes of the guide plates move to positions below the second holes of the disk plate. Subsequently, the gaming tokens retained in the second holes fall into the first holes, and the first holes of the guide plates move from a flat section of the upper face of the columnar or cylindrical body toward pits. The gaming tokens held in the first holes fall into the pits. Subsequently, the thus-dropped gaming tokens are held upright within the gap between an inner face of the outer wall member and the respective token-grooves. By rotation of the columnar or cylindrical body, the gaming tokens held in the gap are pushed toward a direction tangent to an outer peripheral circle of the columnar or cylindrical body.

In such a payout apparatus, the disk plate is rotationally driven along with the columnar or cylindrical body. Hence, the gaming tokens stored in a storage section placed at a position above the disk are agitated appropriately and caused to fall into the second holes of the disk plate. When a plurality of second holes are present and arranged in a concentric arrangement, the gaming tokens are aligned with the concentric circle. In this state, the gaming tokens are held horizontally. When the first holes of the guide plates have moved so as to be located at positions below the second holes of the disk plate in association with rotation of the columnar or cylindrical body, the gaming tokens held in the second holes fall into the first holes. Further, as a result of the guide plate having moved to the pits of the columnar or cylindrical body, the gaming tokens held in the first holes are caused to fall into the pits. In other words, the guide plate has the function of moving the gaming tokens horizontally from the second holes of the disk plate to the pits of the columnar or cylindrical body. The gaming tokens which have fallen into the pits are retained upright within the gap between the token-grooves and the outer wall member. In other words, the pits of the columnar or cylindrical sections have the function of changing, to a vertical orientation, the gaming tokens that have been supplied while remaining in a horizontal orientation. In accordance with movement of the columnar or cylindrical body (i.e., in accordance with movement of the token-grooves), the gaming tokens held in the gap are rotated around the outer periphery of the columnar or cylindrical body. At a predetermined location, the gaming token is pushed to the direction tangent to the outer peripheral circle of the columnar or cylindrical body. Specifically, when pushed out from the columnar or cylindrical body, the gaming token stands upright.

Hence, gaming tokens stored randomly are supplied to the columnar or cylindrical body in good order, and the gaming tokens can be ejected from the columnar or cylindrical body while standing upright. Therefore, there can be considerably reduced mechanical resistance which arises during the course of the transporting member embodied as an escalator rail 317 shown in FIG. 21 converting the transporting direction of gaming tokens to a vertical direction. Further, conversion of the transporting direction of a gaming token can be effected within a very short distance. Hence, the space required for arranging the member for transporting gaming tokens upward can be reduced. In other words, the payout apparatus can be made compact. Moreover, the side face of a gaming token can be pushed by a token-groove (i.e., a columnar or cylindrical body). Hence, transmission of pushing force does not involve friction, thereby enabling pushing of gaming tokens without fail.

The columnar or cylindrical body is rotationally driven while a line (i.e., the "z" axis in the definition) interconnecting the point of center of an upper face circle and that of a lower face circle is taken as the axis of rotation. The columnar or cylindrical body can be made of any material, so long as the columnar or cylindrical body can maintain mechanical strength required for machining and use. However, when magnetic force is utilized for a mechanism for moving guide plates, which will be described later, the columnar or cylindrical body is preferably made of paramagnetic material or diamagnetic material. There can be exemplarily listed polyethylene (PE); polyethylene terephthalate (PET); polytetrafluoroethylene (PTFE); polycarbonate (PC); other fluorine-based resin; resin or plastic such as ABS resin; and metal which is not ferromagnetic material, such as aluminum or stainless steel. Throughout the specification, the term "cylindrical rotational member" is sometimes used as a term synonymous with "columnar or cylindrical body."

Rotational driving force is imparted to the columnar or cylindrical body by, e.g., a motor. The torque may be transmitted directly from a rotary shaft of the motor to the columnar or cylindrical body, or by way of torque transmitter. An appropriately-designed gear or the like can be exemplarily listed as typical torque transmitter. Design particulars, such as the number of gears and a gear ratio, are not disclosed herein, and should be well known to those skilled in the art. The columnar or cylindrical body may be fastened to another member, and the member may be rotationally driven about the axis of rotation (i.e., the "z" axis). In this case, the other member constitutes a portion of the torque transmitter.

The outer wall member covers the outer peripheral face of the columnar or cylindrical body. Material for the outer wall member is analogous to that used for the columnar or cylindrical body. Since the outer peripheral face of the columnar or cylindrical body must be covered, an interior face of the outer wall member must assume a columnar shape. However, the geometry of the outer face of the outer wall section is arbitrary. A rectangular-parallelepiped, a columnar shape, or another arbitrary shape may be adopted as the geometry of the outer face of the outer wall member. The outer wall member may be formed as a single member or integrally with a token storage member, as will be described later. The term "a circumferential wall section surrounding a side face of the cylindrical rotational member" is sometimes used herein as a term synonymous with the term "outer wall member."

The token-grooves are formed in the outer peripheral face of the columnar or cylindrical body. A single token-groove or a plurality of token-grooves may be formed. A plurality of token-grooves are preferable, in consideration that gaming tokens can be ejected with a smaller number of rotations of the cylindrical or columnar body. In the case where a plurality of gaming tokens are provided, they are preferably formed to be symmetric with respect to the axis of rotation when viewed from a position above the columnar or cylindrical body. The outer wall member is provided along the periphery of the columnar or cylindrical body having the token-grooves formed therein. As a result, there is defined a gap between the outer wall member and the token-grooves (i.e., the outer peripheral face of the columnar or cylindrical body), into which one gaming token can be dropped while standing upright. The depth of the token-groove (i.e., the length of the token-groove with respect to the direction towards the center axis of the columnar or cylindrical body) is preferably slightly greater than the thickness "t" of the gaming token. However, so long as the gaming token can be separated from the columnar or cylindrical body (i.e., the token-groove) by a separation member to be described later, no limitation is imposed on the depth of the token-groove. Further, the width of the token-groove (i.e., the length of the token-groove with respect to the direction of the outer periphery of the columnar or cylindrical body) is preferably slightly greater than the diameter "d" of the gaming token. However, so long as the gaming token can be separated from the columnar or cylindrical body (i.e., the token-groove) by a similar separation member, no limitation is imposed n the width of the token-groove. The bottom face or side face of the token-groove may be formed into a flat face or a curved face. Particularly, the side face of the token-groove which exerts a force for pushing a gaming token onto another gaming token by rotation of the columnar or cylindrical body can be curved in accordance with the geometry of the side face of the gaming token.

The pit is formed in the upper face of the columnar or cylindrical body so as to correspond to the location where the token-groove is to be formed. When a single token-groove is to be formed, a single pit is formed. When a plurality of token-grooves are to be formed, pits equal in number to the token-grooves are formed. When viewed from above, openings of the pits assume a geometry which causes at least one gaming token to fall while remaining in a horizontal orientation. The pit and the token-groove can be formed to be integral with each other. No particular limitation is imposed on the position of the pit on the upper face of the columnar or cylindrical body, so long as a first hole of a guide plate, which will be described later, can move to the pit from a flat section of the upper face of the columnar or cylindrical body. However, the pit is preferably formed between the location where the token-groove is to be formed and the axis of rotation. In a case where a plurality of pits are formed, they are preferably formed so as to become symmetric with respect to the axis of rotation. Throughout the specification, the term "tapered section formed in the face of the cylindrical rotational member" is sometimes used as a term synonymous with the term "pit."

The bottom of the pit can be formed into a face tapered toward the upper end of the token-groove. The gaming token that has fallen into the pit goes downward over the tapered face, thereby falling further into the token-groove in an inclined position. Hence, the gaming token can be changed to an upright position without involvement of clogging of gaming tokens. The cone angle of the tapered face with respect to the horizontal plane is preferably set to 30° or more.

The guide plate is to be placed on the upper face of the columnar or cylindrical body and can be moved within a plane parallel with the upper face. The guide plate has a first hole which enables insertion of one gaming token remaining in a horizontal state. Any material can be used for the guide plate, so long as the material can maintain mechanical strength required for machining and use. However, when magnetic force is utilized for a mechanism for moving guide plates, which will be described later, the columnar or cylindrical body is preferably made of paramagnetic material or diamagnetic material. Iron and other magnetic metal can be exemplarily listed. No particular limitation is imposed on the location of the guide plate on the upper face of the columnar or cylindrical body, so long as the guide plate is in a position where the first hole can move to a corresponding pit. Further, the number of guide plates is arbitrary. However, the guide plates are preferably identical in number with the pits (the token-grooves). In a case where a plurality of guide plates are provided, they are preferably provided so as to become symmetric with respect to the axis of rotation of the columnar or cylindrical body.

The guide plate is supported by a pivot on the upper face of the columnar or cylindrical body. The guide plate can pivotally move about the axis of the pivot within a plane parallel to the upper face of the columnar or cylindrical body. If such a guide plate is adopted, the first hole of the guide plate can be moved to the pit from the flat section on the upper face of the columnar or cylindrical body by a simple mechanism and simple operation.

The following configurations can be adopted as mechanisms for moving the guide plate. The mechanism is further equipped with a magnet or magnetic field generator, either being fixedly attached to the outer wall member arranged so as to cover the outer peripheral face of the columnar or cylindrical body. The guide plate is formed from a ferromagnetic material. In this mechanism, the hole (i.e., the first hole) of the guide plate is moved toward the pit, by the force stemming from a magnet or magnetic field generator, in association with rotation of the columnar or cylindrical body. Alternatively, the mechanism further comprises a pin or fixing member fastened to the outer wall member. In this mechanism, in association with rotation of the columnar or cylindrical body, the pin or fixing member comes into contact with the guide plate, whereupon the hole is moved toward the pit. Alternatively, the mechanism is equipped further with a magnet or magnetic field generator fixedly interposed between the axis of rotation of the cylindrical body and the pivot of the guide plate (i.e., the axis of pivot). The guide plate is made of ferromagnetic material. In this mechanism, as a result of pivotal movement of the guide plate about the axis, the guide plate is moved to a position below the second hole of the disk plate (i.e., toward the flat section of the cylindrical body where no pits are formed). Alternatively, the mechanism further comprises pins or fixing members which are fixedly provided between the axis of rotation of the cylindrical body and the pivot (i.e., the axis of pivot) of the guide plate. In this mechanism, in association with rotation of the cylindrical body, the portion of the movable element, which is situated to the inside in relation to the pivot, comes into contact with the pin or fixing member. By such a mechanism, the guide plate can be readily moved by utilization of the rotational driving force of the cylindrical body. The mechanism having the fixing member interposed between the axis of rotation of the cylindrical body and the pivot (i.e., the axis of pivot) of the guide plate cannot be applied to a columnar body. However, if there can be introduced a mechanism in which a fixing member is arranged in the vicinity of the upper face of the columnar body and in a position situated to the inside in relation to the pivot of the guide plate (e.g., a probe-like pin is fixedly arranged from above), a mechanism for moving a guide plate analogous to that mentioned previously can be adopted. Throughout the specification, a state in which the hole of the guide plate has moved toward the flat section is sometimes called a first state, and a state in which the hole of the guide plate has moved toward the pit is sometimes called a second state.

The following requirement can be exemplarily listed as a requirement for specifying the travel distance of the guide plate. More specifically, $0 \leqq L3 < 0.8d$ must be established as a relationship between the diameter "d" of the gaming token and a maximum distance L3 of an open space viewed by way of the hole (i.e., the first hole) of the guide plate while the guide plate has moved over the maximum distance toward the flat section (i.e., in a state in which the first hole of the guide plate has moved to a position below the second hole). Here, "$L3=0$" means that no open space is provided. In other words, the entirety of the first hole of the guide plate is on the flat section. So long as such a requirement is satisfied, the gaming token will not fall into the pit even when a portion of the first hole overlaps the pit (i.e., a certain degree of opening is present), thereby ensuring appropriate operation. In contrast, the travel distance of the guide plate becomes shorter, and hence a larger number of token-grooves and pits can be formed in the columnar or cylindrical body. Thus, the number of supplied gaming tokens per round of the columnar or cylindrical body can be increased.

The disk plate is provided on top of the columnar or cylindrical body and the guide plate and rotates in synchronism with the columnar or cylindrical body. Moreover, the disk plate has a second hole into which one gaming token remaining in a horizontal attitude fits. The number of second holes is arbitrary (either a single hole or a plurality of holes may be provided). Preferably, the second holes are equal in number with the guide plates. Further, the columnar or cylindrical body and the disk plate may be driven separately. Preferably, the columnar or cylindrical body and the disk plate are fixed, and either of these is rotationally driven. No particular limitation is imposed on the location where the second hole is to be formed, so long as the first hole can be moved to a position below the second hole. When a plurality of second holes are formed, they are preferably symmetric with respect to the center axis of rotation. Material for the disk plate is the same as that used for the columnar or cylindrical body. Tapered indentations, each including a projection or a second hole for agitating gaming tokens, maybe formed in the upper face of the disk plate. By agitating action caused by such projections, gaming tokens are efficiently supplied to the second hole. The tapered indentations facilitate supply of gaming tokens to the second hole.

The gaming token payout apparatus may further comprise a separation groove formed in the outer peripheral face of the columnar or cylindrical body, and a separation plate. By use of such a separation groove and separation plate, gaming tokens can be separated from the token-grooves (i.e., the columnar or cylindrical body) without fail.

Here, the separation groove is formed in the outer peripheral face of the columnar or cylindrical body along the outer periphery thereof. The width and depth of the separation groove are arbitrary, so long as the depth enables insertion of the extremity of the separation plate into the separation groove. The separation groove is formed along the outer peripheral face of the columnar or cylindrical body. The height (i.e., a "z" value) of the token-groove assumes an arbitrary value smaller than the diameter "d" of a gaming token. In consideration of reliable separation of a gaming token, the height "h" preferably assumes a value of d/2. In this case, the reference position of the height of the token-groove lies in the center of the width of the token-groove. The extremity of the plate is inserted into the separation groove. The separation groove is a plate to be disposed along an imaginary line tangent to the outer peripheral circle of the columnar or cylindrical body. The separation plate is of arbitrary geometry, so long as the extremity can be inserted into the separation groove. Preferably, the separation plate has a slight bend toward the center of the columnar or cylindrical body (i.e., toward the depth of the separation groove) while being provided on the columnar or cylindrical body. An arbitrary material is used for the separation plate.

The gaming token payout apparatus may be equipped with a transporting member for transporting a gaming token upward (an upward direction from among the directions which are perpendicular to the direction tangent to the outer periphery of the columnar or cylindrical body and which are parallel with the axis of rotation). By the transporting member, the gaming token that has been ejected while standing upright can be transported upward smoothly and reliably. The transporting member has a transport pathway having a cross section slightly larger than the thickness and diameter of a gaming token. The cross section of the transport pathway can be defined by a rectangle having first and second sides. A relationship between the length L1 of the first side and the diameter "d" of the gaming token can be set so as to satisfy $d<L1<1.5d$. A relationship between the length L2 of the second side and the thickness "t" of the gaming token can be set so as to satisfy $t<L2<1.5t$. As a result of these relationships are satisfied, transportation of gaming tokens within the transport pathway can be made smooth, thereby preventing trouble such as clogging. The transport pathway can be formed from a combination of members; e.g., plate members. Moreover, count means for counting transportation (ejection) of gaming tokens can be provided at an arbitrary position in the transporting member. Material for the transporting member is arbitrary and can be, e.g., a metal plate or a metal rod.

The gaming token payout apparatus further comprises a gaming token storage member having a recessed section. The transporting member can be disposed in the recessed section of the storage section. Such a recessed section enables effective agitation of gaming tokens stored in the storage section. Moreover, the transporting member is disposed in the recessed section, thereby enabling miniaturization of the gaming token payout apparatus. The gaming token storage member is disposed in an upper portion of the outer wall member or formed integral with the outer wall member. Here, the recessed section is formed in the horizontal plane or cross section of the gaming token storage member.

Of the configurations of the gaming token payout apparatus, the primary configuration can be solely ascertained as a single invention. The present invention also provides a gaming token payout apparatus comprising: a columnar or cylindrical body; an outer wall member; and a token-groove formed in an outer peripheral face of the columnar or cylindrical body, wherein a gap is defined between an interior face of the outer wall section and the token-groove, and a gaming token which has fallen into the gap is pushed in a direction tangent to the outer peripheral face of the columnar or cylindrical body as a result of rotation of the columnar or cylindrical body. Here, the definition of the columnar or cylindrical body, that of the outer wall member, that of the token-groove, and that of the gap are identical with those provided previously. According to such a payout apparatus, the gaming token fall into the token-groove while standing upright. While standing upright, the gaming token is pushed in a direction tangent to the outer peripheral circle of the columnar or cylindrical body; that is, in a horizontal direction. Hence, gaming tokens can be ejected while standing upright. Further, the force for pushing a gaming token is imparted as a result of an outer peripheral face of a gaming token being directly pushed by the side wall of the token-groove. Therefore, the pushing force can be accurately imparted to the gaming token without use of friction of rollers for pushing action.

Even the gaming token payout apparatus further comprises a separation groove and a separation plate. The payout apparatus further comprises a transporting member for transporting gaming tokens. The definition of the gaming token separation groove, that of the separation plate, and that of the transporting member are identical with those provided previously.

The present invention also provides a gaming token payout apparatus comprising: a columnar or cylindrical body; an outer wall member; a token-groove formed in an outer peripheral face of the columnar or cylindrical body; and a pit formed in an upper face of the columnar or cylindrical body, wherein dropping of the gaming token into the pit is initiated while the gaming token is in a horizontal or inclined position, and the dropped gaming token is retained in an upright position between an interior face of the outer wall member and the token-groove. Such a gaming token payout apparatus enables conversion of orientation of a gaming token from a horizontal position to an upright position. Here, the definition of the columnar or cylindrical body, that of the outer wall member, that of the token-groove, and that of the pit are identical with those provided previously.

The present invention also provides a gaming token payout apparatus comprising: a columnar or cylindrical body; a pit formed in an upper face of the columnar or cylindrical body; and a guide plate, wherein a hole of the guide plate is moved from a flat section on the upper face of the columnar or cylindrical body having no pit formed therein toward the pit, thereby causing a gaming token held in the hole to fall into the pit. Here, formed in the guide plate is a hole of sufficient size for insertion of one gaming token remaining in a horizontal position. Such a gaming token payout apparatus enables implementation of an operation for causing the gaming token held in the hole of the guide plate to fall into the pit by movement of the guide plate. Here, the definition of the columnar or cylindrical body, that of the pit, and that of the guide plate are identical with those provided previously. The hole of the guide plate is similar to the first hole.

The present invention also provides a gaming token payout apparatus comprising: a columnar or cylindrical body; a guide plate having a first hole; and a disk plate having a second hole, wherein the first hole of the guide plate is moved to a position below the second hole in association with rotation of the columnar or cylindrical body, and a gaming token held in the second hole is caused to fall into the first hole of the guide plate. Such a gaming token payout apparatus enables fulfillment of a function of causing a gaming token held in the second hole to fall into the first hole of the guide plate by movement of the guide plate. Here, the definition of the columnar or cylindrical body, that of the guide plate, and that of the disk plate are identical with those provided previously.

The present invention also provides a gaming token payout apparatus comprising: a columnar or cylindrical body; an outer wall member; a disk plate having a second hole; and a gaming token storage member, wherein a cross section of the gaming token storage member taken along a horizontal plane has a recessed section. Such a recessed section enables more effective agitation of reserved gaming tokens. Here, the definition of the columnar or cylindrical body, that of the outer wall member, and that of the disk plate are identical with those provided previously. The gaming token storage member may be disposed in an upper portion of the outer wall member or formed integrally with the outer wall member. Herein, the gaming token storage member is sometimes called a hopper. In some cases, the term "hopper" usually designates the overall gaming token payout apparatus. Under circumstances where those who are skilled in the art construe the present specification with common technical knowledge, the term "hopper" is deemed to be synonymous with the "gaming token storage member," unless a particular technical inconsistency arises.

This gaming token payout apparatus further comprises a transporting member for transporting gaming tokens in a direction which is perpendicular to a direction tangent to an outer peripheral circle of a columnar or cylindrical body and which is parallel with the axis of rotation, wherein the transporting member can be provided in the recessed section. Adoption of such a configuration enables miniaturization of the gaming token payout apparatus.

The present invention also provides a gaming token payout apparatus comprising: a rotatable cylindrical rotational member whose face is formed from a flat section and a tapered section inclined toward an outer periphery and in which indentations corresponding to the thickness of a gaming token are formed in a side face corresponding to the tapered section; and a guide plate which is provided on the face of the cylindrical rotational member, has a gaming token receiving hole for receiving a gaming token whose face is supported by the flat section, and is pivotable between the flat section and the tapered section, wherein a gaming token held in the gaming token receiving hole slides down over the tapered section when the gaming token receiving hole of the guide plate is changed from a first state in which the gaming token receiving hole is situated over the flat section to a second state in which the gaming token receiving hole is situated over the tapered section, as a result of rotation of the cylindrical rotational member; and wherein the gaming token, which is retained by the indentation in a position perpendicular to a radial direction of the cylindrical rotational member, is paid out while remaining in an upright position in association with rotation of the cylindrical rotational member.

In this configuration, a gaming token to be stored in the hopper is received by the gaming token receiving hole of the guide plate. As a result of rotation of the cylindrical rotational member, the gaming token receiving hole of the guide plate shifts from a first state, in which the gaming token receiving hole of the guide plate is situated over the flat section of the cylindrical rotational member, to a second state in which the gaming token receiving hole is situated over the tapered section. As a result, the gaming token held in the gaming token receiving hole slides over the tapered section and is held by the pit. At this time, the gaming token stands upright with respect to the radial direction of the cylindrical rotational member. A gaming token not retained by the pit is paid out in its present form in association with rotation of the cylindrical rotational member.

Preferably, the gaming token retained in an upright position by the indentation of the cylindrical rotational member moves along a circumferential wall section surrounding a side face of the cylindrical rotational member in association with rotation of the cylindrical rotational member, and the gaming token is paid out by way of a gaming token payout section as a result of being pushed by a subsequent gaming token.

In this configuration, the gaming token which is retained by the pit of the cylindrical rotational member and stands upright is moved along the circumferential wall section surrounding the side face of the cylindrical rotational member, in association with rotation of the cylindrical rotational member. When being pushed by a subsequent gaming token, the gaming token is paid out by way of the gaming token payout section.

Preferably, the guide plate is formed from metal having a nature of being attracted by a magnet. The gaming token payout apparatus has a first magnet for attracting an outer peripheral end of the guide plate. When the guide plate in the first state approaches the first magnet as a result of rotation of the cylindrical rotational member, the first magnet attracts the outer peripheral edge of the guide plate in the first state. Consequently, the guide plate shifts from the first state to the second state as the cylindrical rotational member rotates.

In this configuration, the guide plate is formed from metal having a nature of being attracted by a magnet. When the guide plate in the first state approaches the first magnet as a result of rotation of the cylindrical rotational member, the first magnet attracts the outer peripheral edge of the guide plate in the first state. Consequently, the guide plate shifts from the first state to the second state as the cylindrical rotational member rotates.

In a case where the gaming token payout apparatus is used as an upward payout apparatus, disposed at an exit of the gaming token payout section is an escalator for transporting gaming tokens in the form of a chained line. Particularly when a gaming token is paid out from the gaming token payout section by way of the inside of a partially-curved escalator rail; that is, when a gaming token is transported while remaining perpendicular to the radial direction of the cylindrical rotational member, friction developing between the gaming token and the escalator rail is small. Consequently, there is yielded an advantage of smooth transportation of gaming tokens without involvement of clogging at any point along the path to the gaming token payout port.

Since a gaming token advances through the inside of the escalator rail while standing upright; that is, while a periphery of the gaming token is supported, the radius of curvature of a curved section can be set so as to become substantially the same as that of the gaming token. Since the radius of curvature of the curved section can be reduced, the escalator rail can be shortened. As a result, the space occupied by the escalator rail can be reduced.

Here, it is preferable that the gaming token payout apparatus further comprises a second magnet for attracting a reverse face in the vicinity of an inner periphery of the guide plate. When the guide plate that has entered the second state approaches the second magnet as a result of rotation of the cylindrical rotational member, the second magnet attracts the reverse face in the vicinity of the inner periphery of the guide plate in the second state. Consequently, as the cylindrical rotational member rotates, the gaming token guide section shifts from the second state to the first state.

In this configuration, when the guide plate that has entered the second state approaches the second magnet as a result of rotation of the cylindrical rotational member, the second magnet attracts the reverse face in the vicinity of the inner periphery of the guide plate in the second state. Consequently, as the cylindrical rotational member rotates, the gaming token guide section shifts from the second state to the first state.

Preferably, the gaming token payout apparatus further comprises: a cover which has a hole greater in diameter than a gaming token to be stored in the hopper, comes into slidable contact with the flat section of the cylindrical rotational member, and constitutes a bottom of the hopper. In a state in which the gaming token stored in the hopper is fitted into the hole of the cover, the gaming token held in the hole of the cover is received by the gaming token receiving hole of the guide plate when the guide plate has shifted from the second state to the first state.

In this configuration, when the guide plate has shifted from the second to first state while the gaming token to be stored in the hopper is held in the hole of the cover, the gaming token held in the hole of the cover is received by the gaming token receiving hole of the guide plate.

As mentioned above, the guide plate that has entered the second state can be returned to the first state. The gaming token held in the hole of the cover is received by the gaming token receiving hole of the guide plate that has entered the first state. Consequently, the gaming tokens stored in the hopper can be paid out sequentially by bringing the guide plate into the first or second state, as required, while the cylindrical rotational member is rotated.

DETAILED DESCRIPTION OF THE PREFERRED EMBODIMENTS

Figure 1:
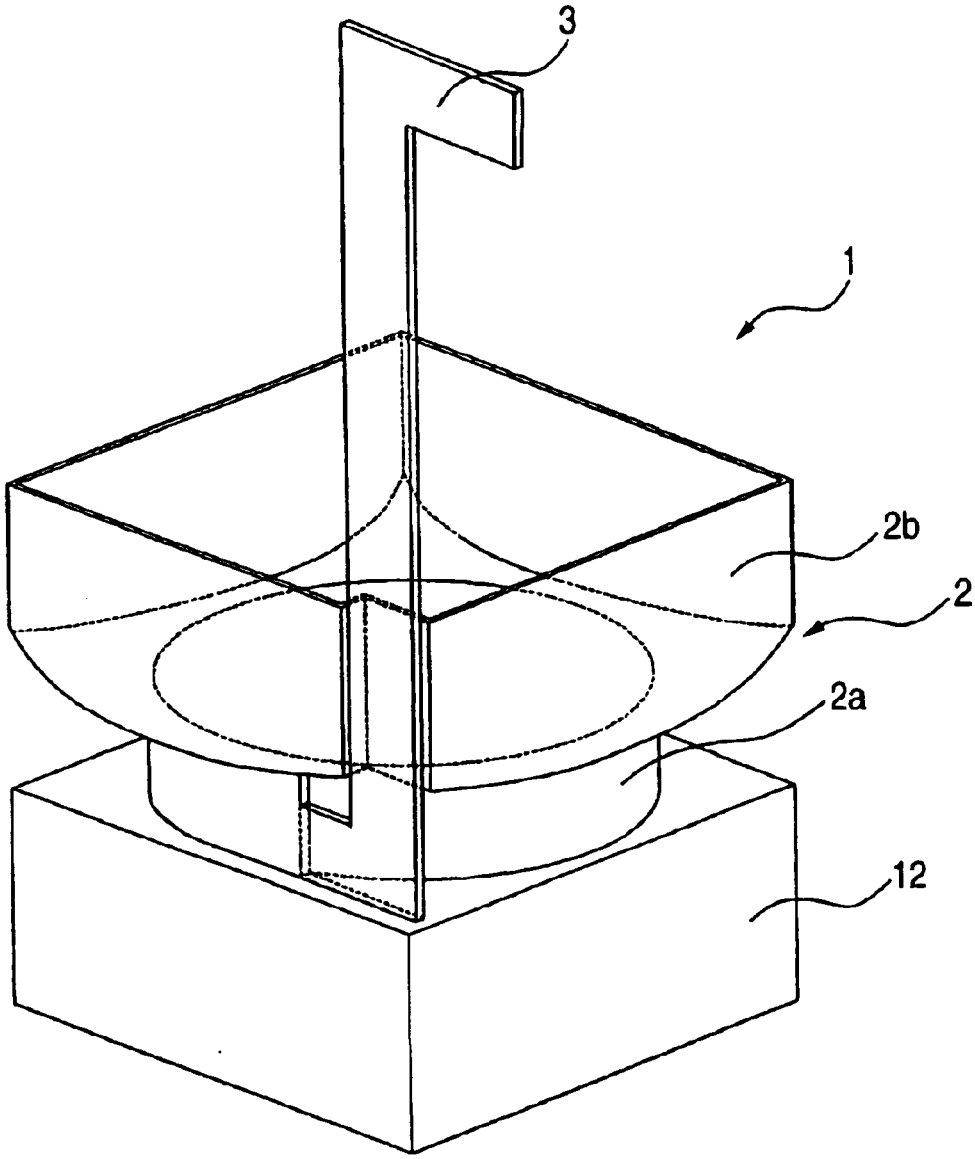
FIG. 1 is an overall schematic diagram showing an example of a gaming token payout apparatus according to a first embodiment of the invention.

Embodiments of the invention will be described in detail hereinbelow by reference to the accompanying drawings. The invention can be implemented in many different forms and should not be construed as being limited to descriptions of the embodiments. Throughout the embodiments, like elements are assigned like reference numerals.

Figure 2:
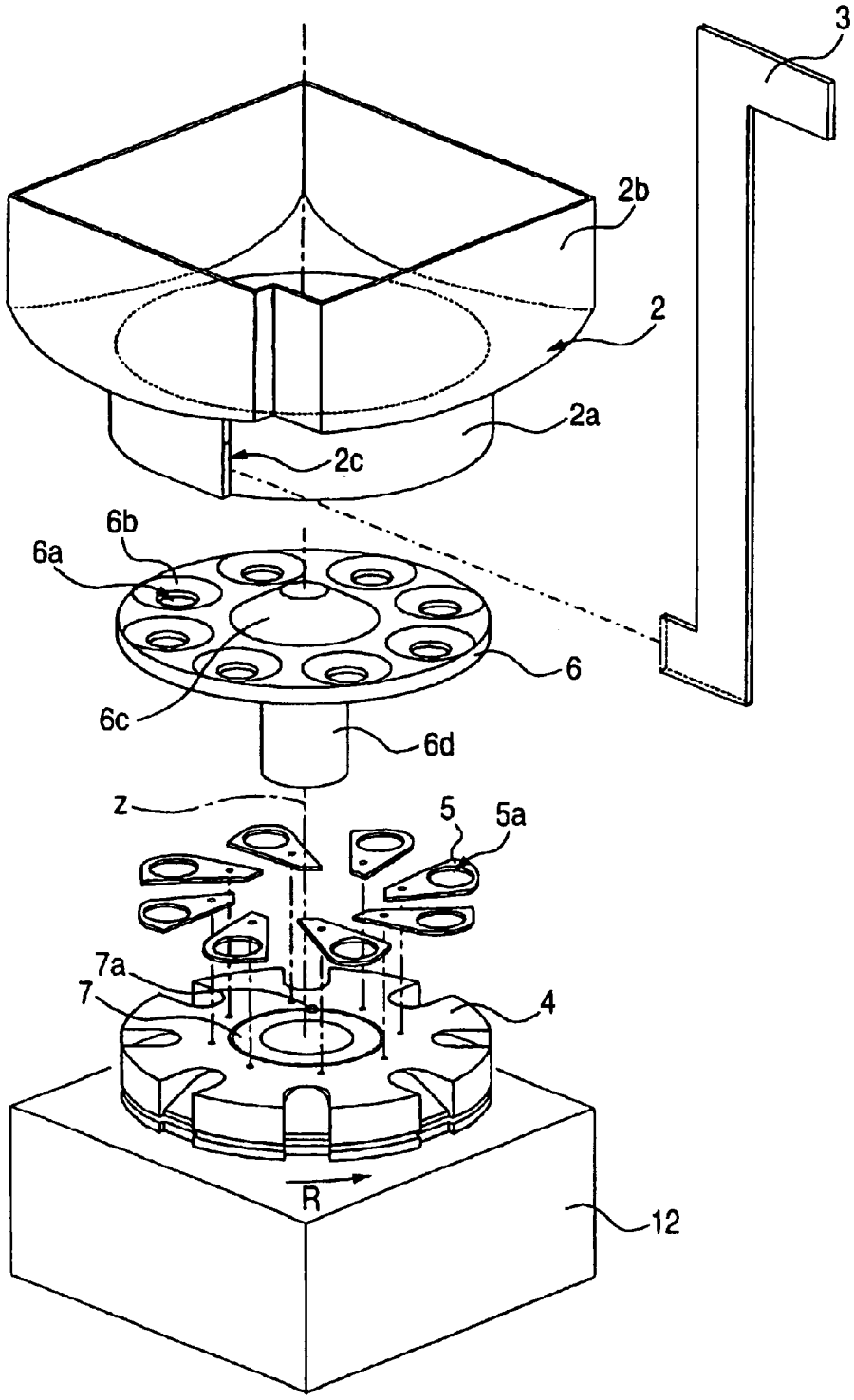
FIG. 2 is an exploded perspective view showing the gaming token payout apparatus shown in FIG. 1.

As shown in FIGS. 1 and 2, a gaming token payout apparatus 1 according to a first embodiment includes a hopper 2; an escalator 3; a rotary cylinder 4; guide plates 5; a disk plate 6; a fixing member 7; and a base 12.

The hopper 2 is formed from resin; e.g., plastic, and has an outer wall section 2*a* and a storage section 2*b*. The outer wall section 2*a* and the storage section 2*b* may be formed into a single piece or as separate members. The outer wall section 2*a* is a wall member to be placed at the position of an outer periphery of the rotary cylinder 4 to be described later. Gaming tokens are retained in an upright position within a gap defined between an inner peripheral face of the outer wall section 2*a* and the outer periphery of the rotary cylinder 4. The outer wall section 2*a* has a gaming token discharging section 2*c*. Gaming tokens remaining in an upright position are pushed and ejected by way of the gaming token discharging section 2*c*. The thus-ejected gaming tokens are pushed into a lower part of the escalator 3. The storage section 2*b* is a member for reserving the gaming tokens which have been inserted and have fallen into the storage section 2*b*.

The escalator 3 is a mechanism for transporting gaming tokens upward. A lower portion of the escalator 3 is connected to the gaming token discharging section 2*c* from which a gaming token is pushed and ejected. A transport pathway is formed within the escalator 3, and gaming tokens are held in an upright position within the pathway. The pathway is filled with gaming tokens which have been pushed into the pathway from the lower portion of the escalator 3. As gaming tokens are pushed into the lower portion of the escalator 3, the gaming tokens having already been in the pathway are ejected from an upper portion of the escalator 3. The escalator 3 can be constituted of a plurality of metal plate members, metal lumber members, or the like.

The base 12 is a substructure of the gaming token payout apparatus 1 and is used for mounting various members. Housed in the base 12 are an unillustrated motor and rotational driving force transmitter. The motor imparts rotational driving force to the rotary cylinder 4.

The fixing member 7 is a cylindrical member to be mounted on the base 12. The fixing member 7 is arranged such that its center axis is aligned with the axis of rotation "z." A fixing pin 7*a* is provided on top of the fixing member 7. The fixing member 7 is formed from resin, such as plastic, and the fixing pin 7*a* is formed from, e.g., metal.

The rotary cylinder 4 is a cylindrical member which rotates around the axis of rotation "z." The rotary cylinder 4 is arranged such that an inner circumferential face (i.e., interior face) of the rotary cylinder 4 comes into contact with an outer peripheral face of the fixing member 7. Resin, such as plastic, can be exemplarily listed as material for the rotary cylinder 4. Although the rotating direction of the rotary cylinder 4 is arbitrary, the rotary cylinder 4 will be hereinafter described as being rotatably driven in illustrated direction R. Pits are formed in an upper face of the rotary cylinder 4, and grooves and a separation groove are formed in the outer peripheral face of the rotary cylinder 4.

The guide plates 5 are provided on top of the rotary cylinder 4 and correspond to plate members pivotable within a horizontal plane. As will be described later, the guide plates 5 are provided such that the center of pivotal movement of the plate is pivotally supported on the upper face of the rotary cylinder 4. Consequently, the guide plates 5 are pivotable about the pivotally-supported portions thereof. In association with rotation of the rotary cylinder 4, the guide plates 5 are collectively rotated about the axis of rotation "z." Ferromagnetic material; for example, iron, can be exemplarily listed as material for the guide plates 5. Each of the guide plates 5 has a first hole 5*a*. The diameter of the first hole 5*a* is larger than that of a gaming token. One gaming token can be retained in a horizontal position within the first hole 5*a*. The guide plate 5 is formed so as to become substantially identical in thickness with or slightly greater in thickness than a gaming token. Although eight guide plates 5 are provided in FIG. 2, some are not labeled with reference numerals.

The disk plate 6 is a member which rotates in conjunction with the cylindrical member 4, and constitutes a bottom portion of the storage section 2*b*. Resin, such as plastic, can be exemplarily listed as material for the disk plate 6. The disk plate 6 has second holes 6*a*. Each of the second holes 6*a* is greater in diameter than a gaming token. One gaming token can be retained in a horizontal position within the second hole 6*a*. The second hole 6*a* is formed so as to become substantially identical in thickness with or slightly greater in thickness than a gaming token. A tapered indentation 6*b* is formed in an outer periphery portion of the second hole 6*a*. Formation of the indentation 6*b* facilitates dropping of a gaming token into the second hole 6*a*. Although eight second holes 6*a* and eight indentations 6*b* are illustrated in FIG. 2, some are not labeled with reference numerals.

A cone-shaped projection 6*c* is provided on the upper face of the disk plate 6. By the projection 6*c*, reserved gaming tokens are guided toward the tapered indentations 6*b* under the force of gravity. Thus, the gaming tokens are more easily caused to fall into the second holes 6*a*. Although not illustrated, other projections may be provided on the upper face of the disk plate 6. By such projections, gaming tokens can be agitated in association with rotation of the disk plate 6.

A columnar member 6*d* is provided on the bottom face of the disk plate 6. The columnar member 6*d* and the disk plate 6 may be formed into a single piece or as separate members. The columnar member 6*d* is inserted into an inner cylinder of the fixing member 7 and acts as a rotary shaft. Therefore, the disk plate 6 is fixed to the rotary cylinder 4, and the rotary cylinder 4 can be rotated by imparting rotational driving force to the columnar member 6*d*.

Figure 3:
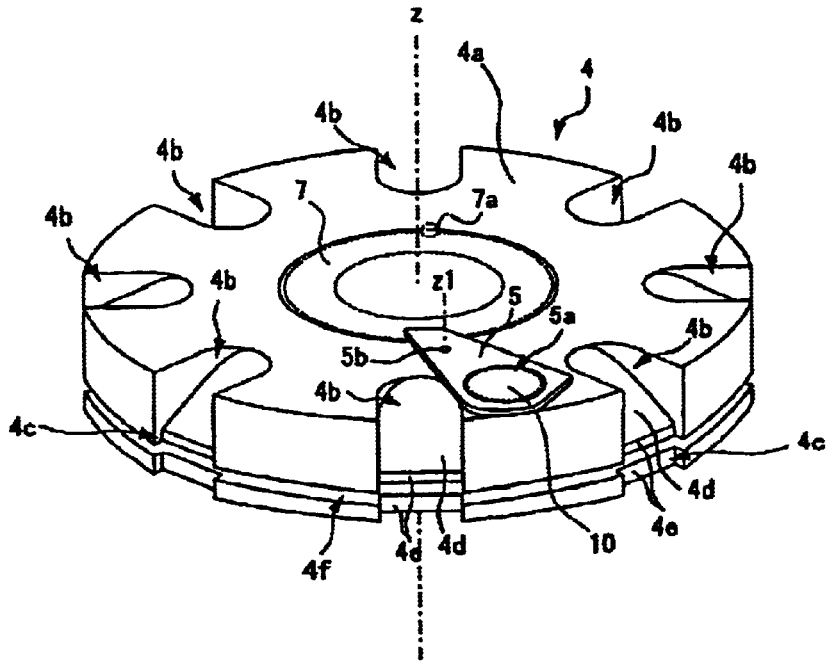
FIG. 3 is a perspective view showing details of a cylindrical body and those of guide plates.

FIG. 3 is a perspective view showing details of the rotary cylinder 4 and those of the guide plates 5. Only one of the eight guide plates 5 is illustrated, and the others are omitted. Moreover, some of the illustrated guide plates 5 are not labeled with reference numerals.

A flat section 4*a* and the pits 4*b* are formed on and in the upper face of the rotary cylinder 4. Token-grooves 4*c* and a separation groove 4*f* are formed in the outer peripheral face of the rotary cylinder 4. As will be described later, the pit 4*b* has the geometry of an opening which causes a gaming token to fall while assuming a horizontal attitude, by an action to be described later. As illustrated, the geometry of the pit 4*b* may be such that a circle and a rectangle are merged. The geometry of an opening of the pit 4*b* is not limited to the foregoing example; any other geometry may be adopted, so long as the geometry causes a gaming token to fall while assuming a horizontal attitude. For example, there may be adopted a quadrilateral, such as a rectangle.

A bottom face 4*d* of each pit 4*b* is tapered as illustrated. A cone angle of the tapered face with reference to the horizontal plane is preferably set to 30° or more; for example, 45°. Here, the bottom face 4*d* of the pit 4*b* is illustrated as a tapered flat face. However, the bottom face 4*d* does not need to be flat; the bottom face 4*d* may assume a conical shape or the shape of another curved face. Here, the bottom face 4*d* of the pit 4*b* is illustrated as a tapered face, but is not limited thereto. Any geometry can be adopted, so long as the geometry enables a fallen gaming token to fit into the token-groove 4*c* in an upright position. For instance, a projection may be formed such that the extremity of the projection is located at a position higher than the upper end of the bottom face 4*e* of the token-groove 4*c*.

As illustrated, the token-grooves 4*c* are formed in the side face of the rotary cylinder 4. The bottom face of each token-groove 4*c* is designated by 4*e*. As illustrated, the pit 4*b* and the token-groove 4*c* are integral with each other while being formed in the rotary cylinder 4. A boundary between the pit 4*b* and the token-groove 4*c* is merely a conceptual boundary.

As illustrated, the separation groove 4*f* is a single groove formed in the outer periphery of the rotary cylinder 4. The depth, width, and action of the separation groove 4*f* will be described later.

Each guide plate 5 is pivotally supported on the flat section 4*a* of the rotary cylinder 4 by way of a pivotal support section 5*b*. Hence, the guide plate 5 can pivot about the pivotal support section 5*b* (i.e., about an axis z1). A gaming token 10 held in the first hole 5*a* of the guide plate 5 falls into the pit 4*b* as a result of the guide plate 5 pivoting toward the pit 4*b*.

A stopper for restricting the pivotable angle (i.e., a travel distance) of each of the guide plates 5 is provided on the upper face of the rotary cylinder 4, but is omitted from the drawing.

Figure 4:
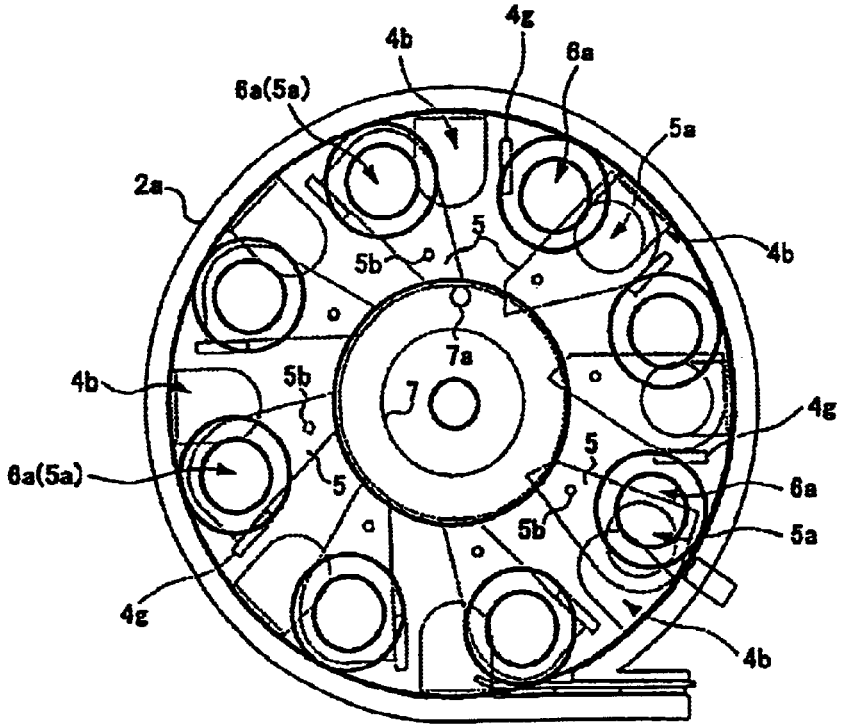
FIG. 4 is a top view showing positional relationships between pits, first holes of the guide plates, and second holes of disk plates, all being provided on an upper face of the cylindrical body.

As shown in FIG. 4, the pits 4*b*, the pivotal support sections 5*b* of the guide plates 5, and the second holes 6*a* of the disk plates 6 are formed so as to be symmetric about the axis of rotation of the rotary cylinder 4. The second holes 6*a* of the disk plate 6 are arranged so as to be situated on the flat section 4*a* of the rotary cylinder 4. The first holes 5*a* of the guide plates 5 pivot about the respective pivotal supports 5*b*. Each of the guide plates 5 is arranged so as to be able to move back and forth between the corresponding second hole 6*a* and pit 4*b*. By the configuration, the gaming token held in the second hole 6*a* is caused to fall into the corresponding first hole 5*a*, as will be described in subsequent descriptions of operation. The guide plate 5 moves and can cause the gaming token to fall into the corresponding pit 4*b*. The movement of the guide plate 5 is restricted by a limiter 4*g* formed on the upper face of the rotary cylinder 4. The positions at which the guide plates 5 are to be stopped correspond to the locations where the second holes 6*a* overlap the corresponding first holes 5*a* and locations where the first holes 5*a* overlap the corresponding pits 4*b*.

Figure 5A:
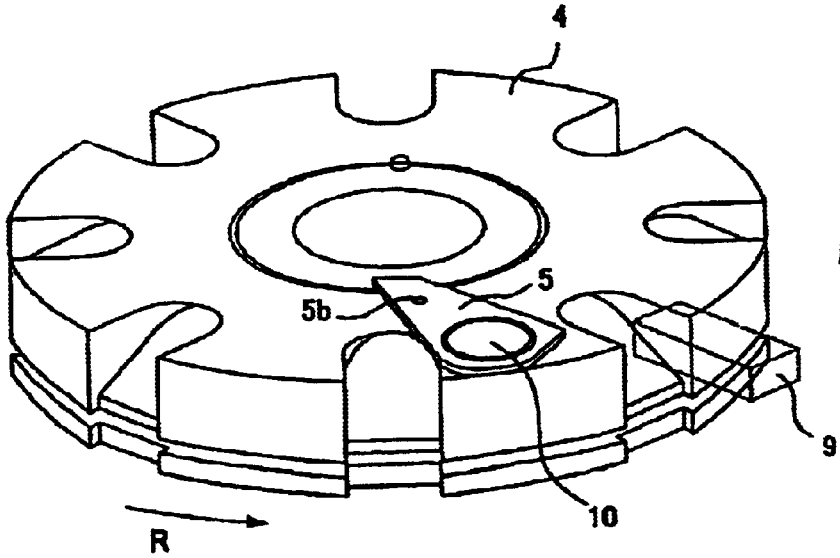
FIGS. 5A and 5B are perspective views for describing a mechanism for causing a gaming token held in a first hole of the guide plate to fall into a token-groove.
Figure 5B:
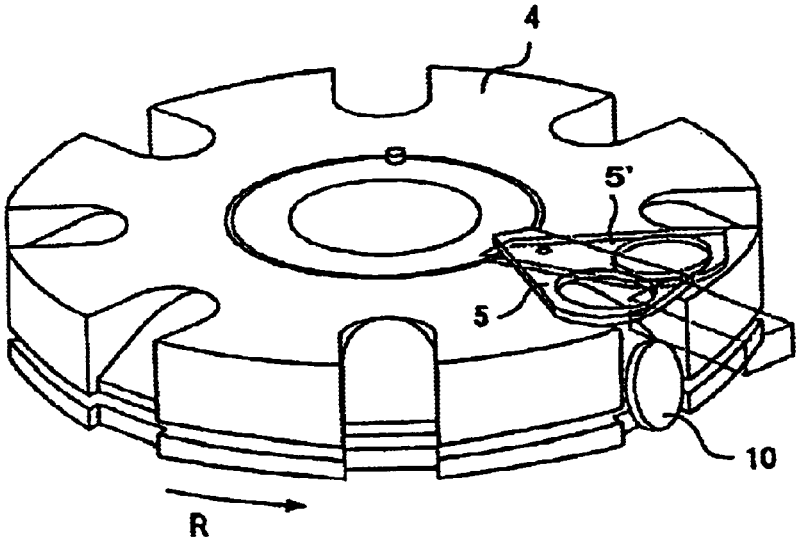

The movement and operation of each of the previously-described members will now be described. FIGS. 5A and 5B are perspective views for describing a mechanism for causing the gaming token 10 held in the first hole 5*a* of the guide plate 5 to fall into the token-groove 4*c*. Members other than those to be described and some reference numerals are omitted. As shown in FIG. 5A, it is assumed that, while the gaming token 10 is held in the first hole 5*a* of the guide plate 5, the cylindrical plate 4 rotates in direction R. A magnet 9 is disposed in an illustrated position. Here, the magnet 9 is exemplified, but there may be adopted a coil or another magnetic-field generator which enables flow of an electric current.

In association with rotation of the rotary cylinder 4, the guide plates 5 pivotally supported on the rotary cylinder 4 by the pivotal support sections 5*b* are also rotated in the direction R. When the guide plate 5 is rotated up to the position where the magnet 9 is disposed and the rotary cylinder 4 rotates further, the guide plate 5 is pulled by the magnet 9 by its magnetic force and starts pivoting about the pivotal support section 5*b* in the direction opposite the direction R. When the first hole 5*a* of the guide plate 5 has moved to a corresponding pit 4*b*, the gaming token 10 falls into the pit 4*b*. The thus-dropped gaming token 10 slides over the tapered face of the bottom face 4*d* of the pit 4*b* and is brought into an upright attitude by the token-groove 4*c*. Although the outer wall section 2*a* is omitted from the drawing, the gaming token 10 stands upright by virtue of the outer wall section 2*a*. FIG. 5B shows this situation.

As has been mentioned, the gaming token 10 is caused to fall into (a gap between the external wall section 2*a* and) the token-groove 4*c* by utilization of rotation of the rotary cylinder 4. The thus-fallen gaming token 10 rotates along with the rotary cylinder 4 in association with its rotation.

Figure 6A:
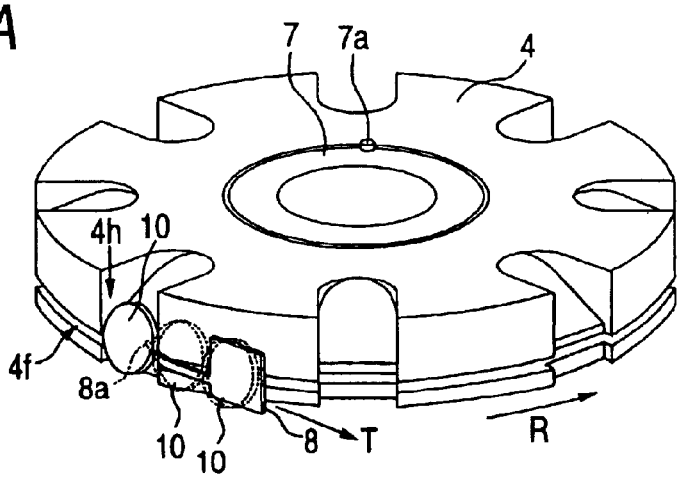
FIGS. 6A to 6C are drawings for describing a mechanism for separating the gaming token held in the token-groove by a separation plate.
Figure 6B:
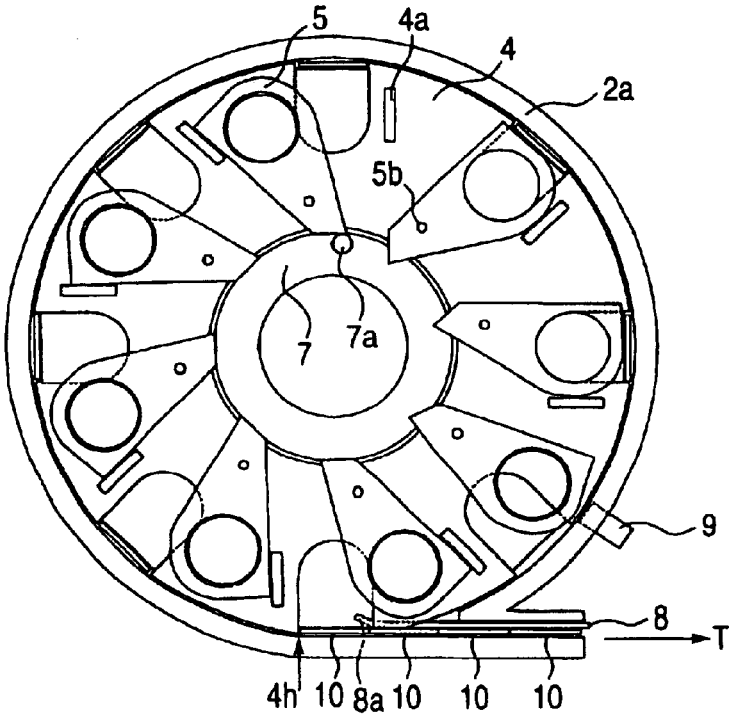
Figure 6C:
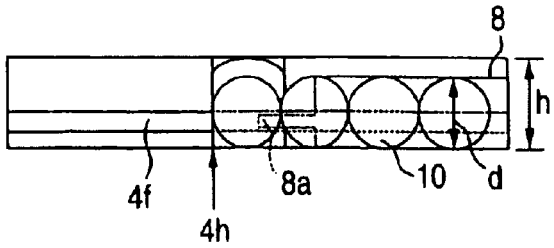

FIGS. 6A, 6B, and 6C are drawings for describing a mechanism for separating the gaming token 10 held in the token-groove 4*c* by a separation plate. FIG. 6A is a perspective view; FIG. 6B is a top view; and FIG. 6C is a side view. The separation plate 8 is placed in line with an imaginary line tangent to a peripheral circle of the rotary cylinder 4. Any material can be used for the separation plate 8. An extremity 8*a* of the separation plate 8 is inserted into the separation groove 4*f*. The width and depth of the separation groove 4*f* may be set to any values, so long as they allow insertion of the extremity 8*a* of the separation plate 8. Moreover, the height of the separation groove 4*f* may be set to any value, so long as the gaming token 10 is caught by the separation groove 4*f*. Desirably, the separation groove 4*f* is formed such that the extremity 8*a* of the separation plate 8 is located at a position lower than the position of the diameter of the gaming token 10. In order to separate the gaming token 10 effectively, the position of the separation groove 4*f* (i.e., the position where the extremity 8*a* of the separation plate 8 is located) is preferably at a position in the vicinity of the gaming token 10. As a result, a gap is defined between the separation plate 8 and the outer wall section 2*a*, thus forming a transport pathway.

As mentioned previously, the gaming token 10 that has fallen into the token-groove 4*c* is moved in association with rotation of the rotary cylinder 4, up to the position where the separation plate 8 is placed. When the rotary cylinder 4 rotates, the edge of the gaming token 10 oriented in the direction R is caught by the extremity 8*a* of the separation plate 8. The thus-caught gaming token 10 is guided by the separation plate 8 into the transport pathway defined between the separation plate 8 and the external wall section 2*a*. Here, transportation of the gaming token 10 is implemented by pushing action stemming from the rotating force of the rotary cylinder 4. In short, the gaming token 10 undergoes the pushing action and force from the side face 4*h* of the token-groove 4*c* and is pushed into the tangential direction T of the peripheral circle. As mentioned above, the rotational force of the rotary cylinder 4 is exerted directly on the gaming token 10 by the side face 4*h* of the token-groove 4*c*. Hence, the gaming token 10 can be pushed without fail.

The height "h" of the rotary cylinder 4 (i.e., the depth of the gaming token token-groove 4*c*) is preferably between 1.3 times and 1.5 times, inclusive, the diameter "d" of the gaming token 10.

Figure 7:
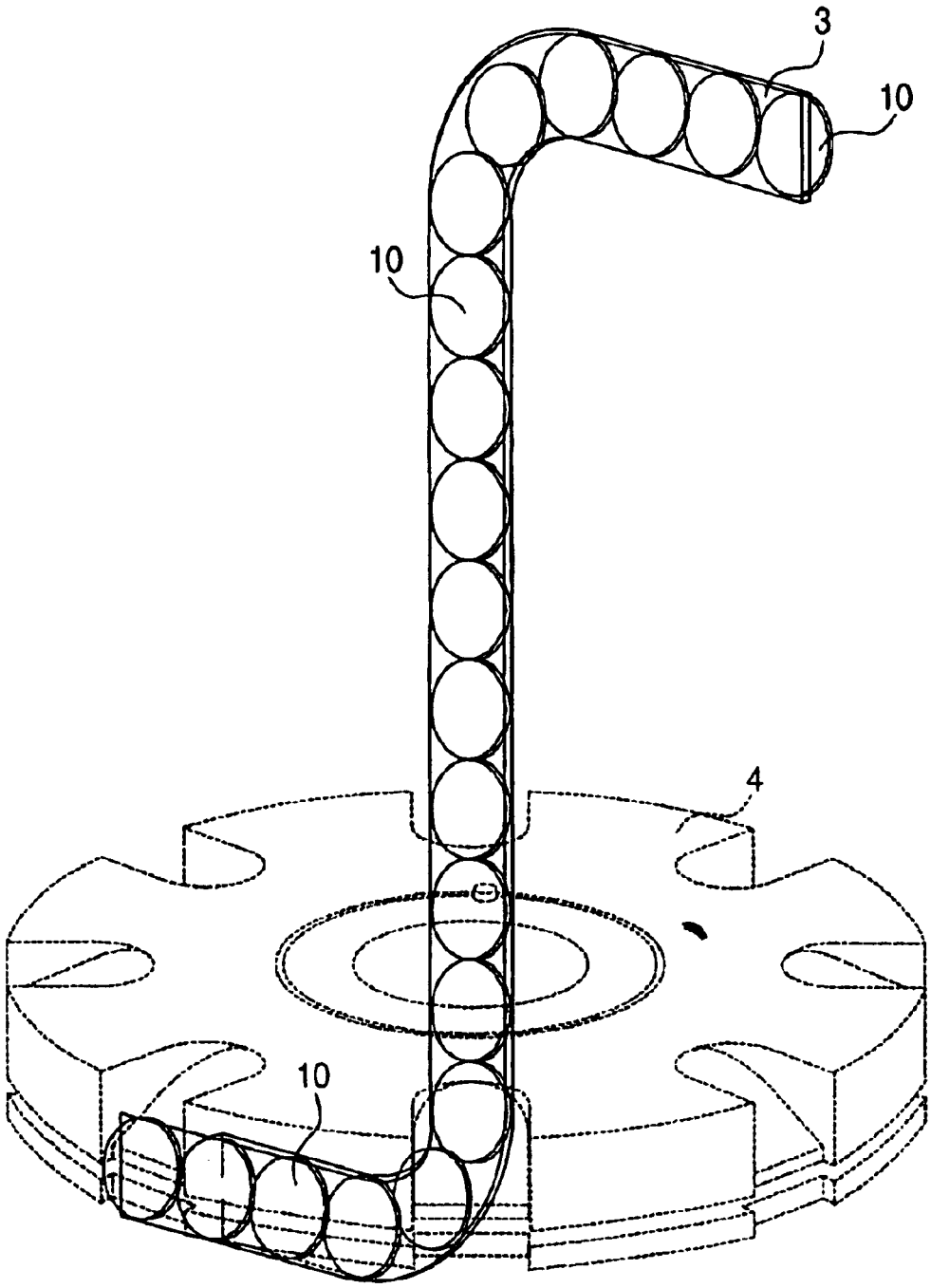
FIG. 7 is a perspective view showing a manner in which the pushed gaming token is guided to an escalator and ejected from the upper portion of the escalator.

As illustrated in FIG. 7, the gaming token 10 is ejected while remaining upright. Hence, even when the transporting direction of the gaming token 10 is changed to an upward direction within the transport pathway of the escalator 3, the gaming token 10 can readily rotate within the transport pathway. Therefore, resistance stemming from transportation becomes considerably small. Therefore, gaming tokens can be transported smoothly upward without fail.

Figure 8:
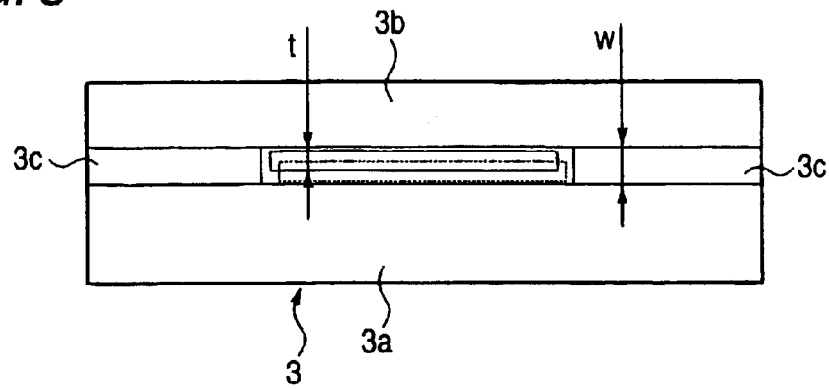
FIG. 8 is a view showing a cross section of the transport pathway of the escalator.

As shown in FIG. 8, the transport pathway for a gaming token can be constituted of a space surrounded by, e.g., plate members 3*a*, 3*b* and a lumber member 3*c*. The width "w" of the space of the transport pathway can be set to 1.5 times the thickness "t" of a gaming token. On condition that a margin required for passage of a gaming token is ensured, the width "w" can be made smaller than 1.5t. As mentioned previously, the gaming token payout apparatus according to the embodiment involves considerably small mechanical resistance in the transport pathway. Therefore, in consideration of clogging of gaming tokens, the width "w" of the transport pathway does not need to be made smaller than necessary. The gaming token payout apparatus according to the embodiment yields an advantage of the ability to design a transport pathway with relatively low precision.

Figure 9A:
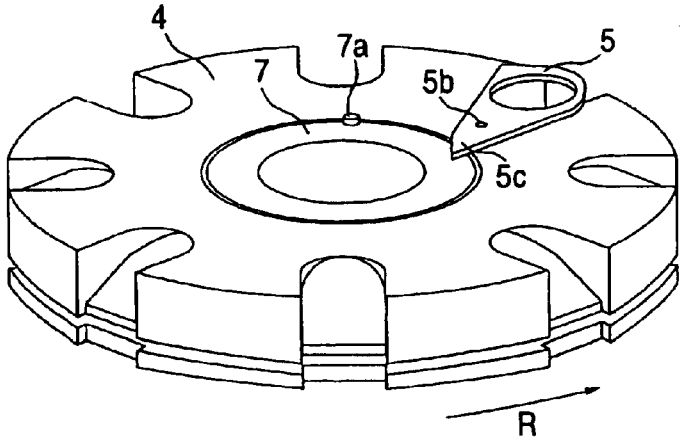
FIGS. 9A and 9B are perspective views for describing a mechanism by which the guide plate moves from a pit of the cylindrical body toward a flat section.
Figure 9B:
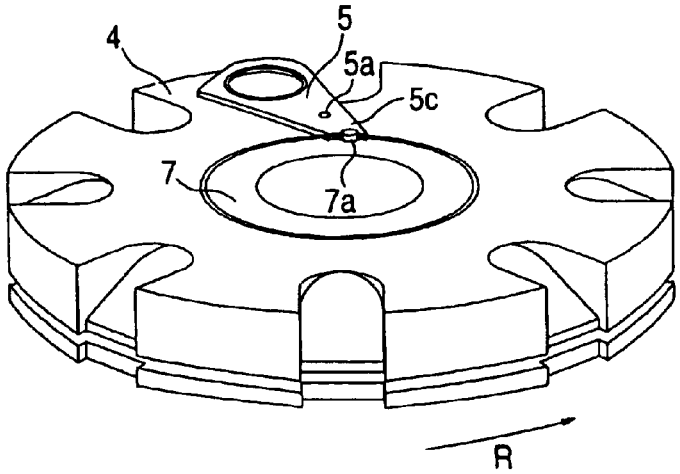

As shown in FIG. 9A, the guide plate 5 into which the gaming token 10 has fallen is situated at a position above the pit 4*b*. If the rotary cylinder 4 rotates in this state, an end 5*c* of the guide plate 5 comes into collision with a fixed pin 7*a* provided on the fixing member 7. When the rotary cylinder 4 rotates further, the end 5*c* of the guide plate 5 receives acting force from the fixing pin 7*a*, to thereby undergo relative motion in the direction opposite the rotating direction R. At this time, the guide plate 5 is pivotally supported by the pivotal support section 5*b*. Hence, in association with rotation of the rotary cylinder 4, the first hole 5*a* moves in the rotating direction R. FIG. 9B shows this state. The limiter 4*g* for restricting the range of movement of the guide plate 5 is omitted from the drawing. When the state shown in FIG. 9B is achieved, as shown in FIG. 4, the first hole 5*a* is situated at a position below the second hole 6*a* of the disk plate 6. As a result, the gaming token 10 held in the second hole 6*a* falls into the first hole 5*a*, and the gaming token 10 is held in the first hole 5*a*. When having arrived at the position of the magnet 9 in the manner as described previously, the gaming token 10 is caused to fall into the token-groove 4*c*.

Figure 10:
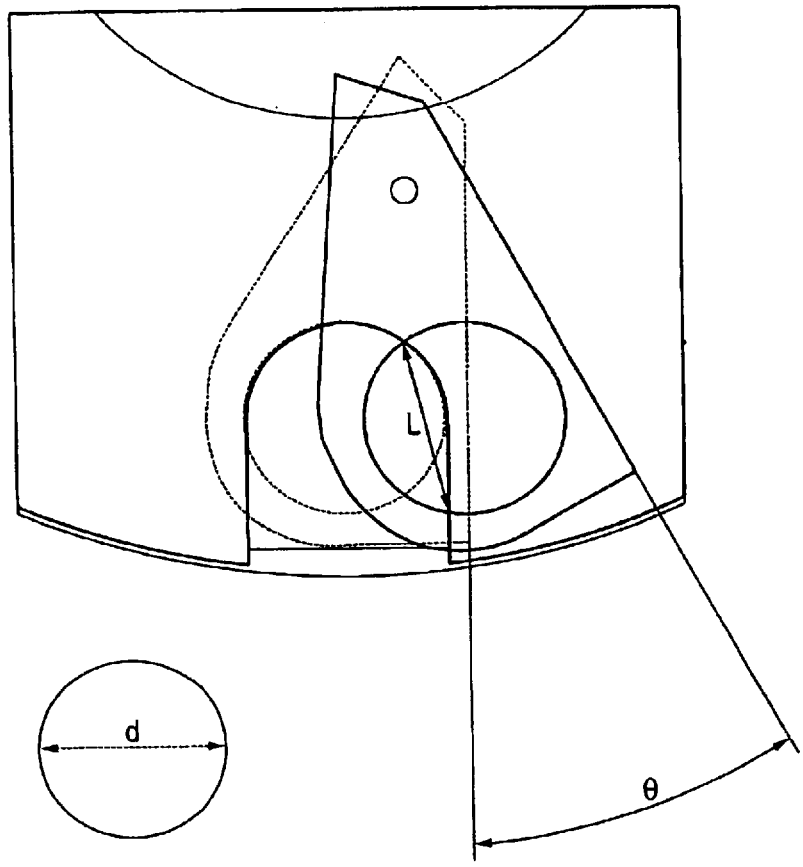
FIG. 10 is a fragmentary top view showing an example in which a first hole of the guide plate has moved over the maximum distance toward the flat section of the cylindrical body.

As illustrated, the first hole 5*a* can be arranged such that when the first hole 5*a* has moved over the maximum distance toward the flat section 4*a*, the entirety of the first hole 5*a* is situated at a position above the flat section 4*a* of the rotary cylinder 4. However, there is no requirement that the entirety of the first hole 5*a* moves to a position above the flat section 4*a*; a portion of the first hole 5*a* may overlap the pit 4*b*. FIG. 10 is a fragmentary top view showing an example in which the first hole 5*a* of the guide plate 5 has moved over the maximum distance toward the flat section 4*a* of the rotary cylinder 4 (i.e., the direction R). As illustrated, a portion of the first hole 5*a* may overlap the pit 4*b*; that is, the pit 4*b* can be seen through the first hole 5*a*. In this case, the maximum distance L of a space viewed by way of the first hole 5*a* must be smaller than 0.8 times the diameter "d" of the gaming token 10. The value is determined by reference to a critical value (L=d), at which the gaming token 10 is caused to fall into the pit 4*b*, and while allowing for a design margin. By setting L to as large a value as possible, the rotation angle θ of the guide plate 5 can be made small, so that a larger number of pits 4*b* can be formed in the rotary cylinder 4 of the same diameter, thereby increasing the number of gaming tokens which are to be ejected by one rotation. This corresponds to relative miniaturization of a gaming token payout apparatus.

As is self-evident, the gaming tokens 10 are naturally supplied to the second holes 6*a* of the disk plate 6 by appropriate agitation of the gaming tokens reserved in the storage section 2*b* located above the disk plate 6.

Figure 11A:
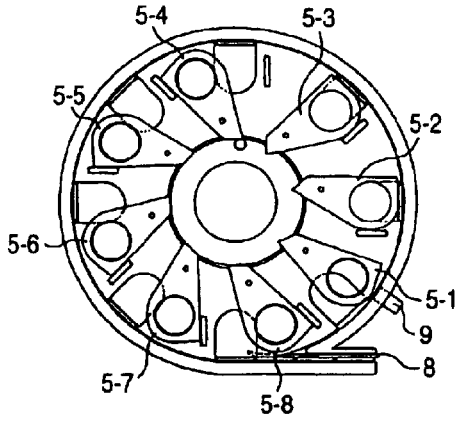
FIGS. 11A to 11E are top views showing a round of operations to be performed by the gaming token payout apparatus according to the first embodiment.
Figure 11B:
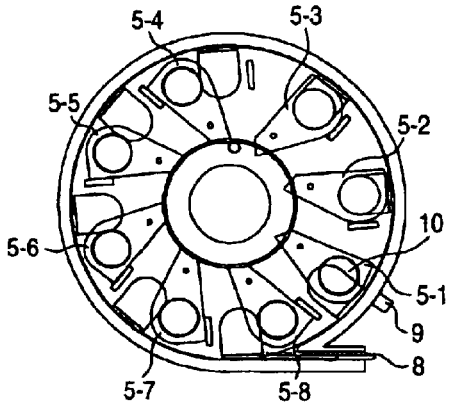
Figure 11C:
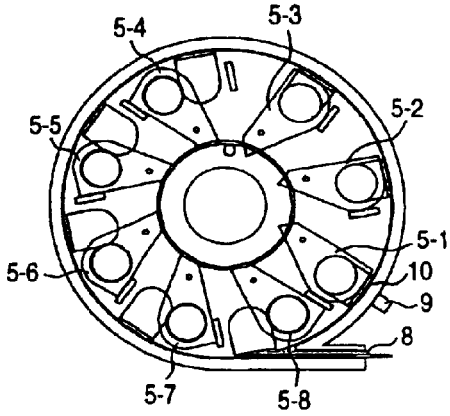
Figure 11D:
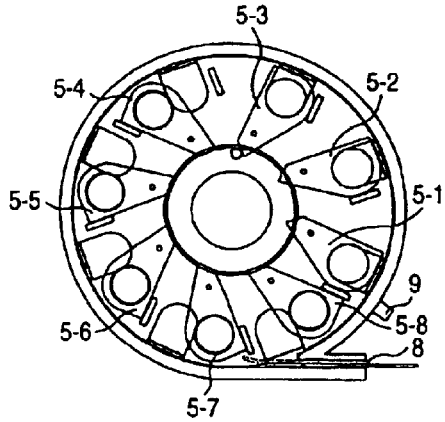
Figure 11E:
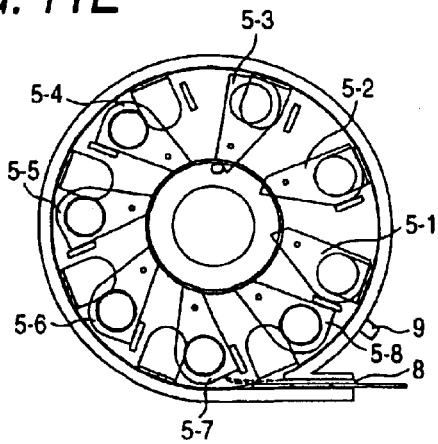

A round of operations is described by reference to FIG. 11A through 11E. As illustrated in FIG. 11A, it is assumed that a guide plate 5-1 is located at the position of the magnet 9. In this state, the extremity 8*a* of the separation plate 8 is in the course of coming into collision with the reverse face of the gaming token located in the token-groove 4*c*. As the rotary cylinder 4 rotates, as shown in FIG. 11B the guide plate 5-1 is drawn by the magnet 9 and undergoes relative motion in the direction opposite the rotating direction of the rotary cylinder 4. In this state, the gaming token 10 held in the token-groove 4*c* is separated, and the thus-separated gaming token 10 is guided and pushed into the transport pathway by the separation plate 8. As shown in FIG. 11C, in a phase in which the guide plate 5-1 has moved to a position above the pit 4*b*, the gaming token 10 held in the guide plate 5-1 is caused to fall into the token-groove 4*c*. In this state, the gaming token 10 held in the token-groove 4*c* is further pushed out. When the rotary cylinder 4 rotates further, as shown in FIG. 11D an end of a guide plate 5-3 comes into collision with the fixed pin 7*a*. In this state, the gaming token 10 held in the token-groove 4*c* is completely pushed out, whereby one gaming token is paid out to the payout port. As shown in FIG. 11E, when the rotary cylinder 4 rotates further, the guide plate 5-3 starts moving toward the flat section 4*a* of the rotary cylinder 4 (i.e., to a position below the second hole 6*a* of the disk plate 6). When the rotary cylinder 4 has moved to the position shown in FIG. 11A, the first hole 5*a* of the guide plate 5-3 reaches a position below the second hole 6*a* of the disk plate 6. When the second hole 6*a* has come to coincide with the first hole 5*a*, a gaming token is supplied to the hole of the guide plate 5-3.

As has been described, a gaming token standing upright is ejected in association with rotation of the rotary cylinder 4.

Figure 12:
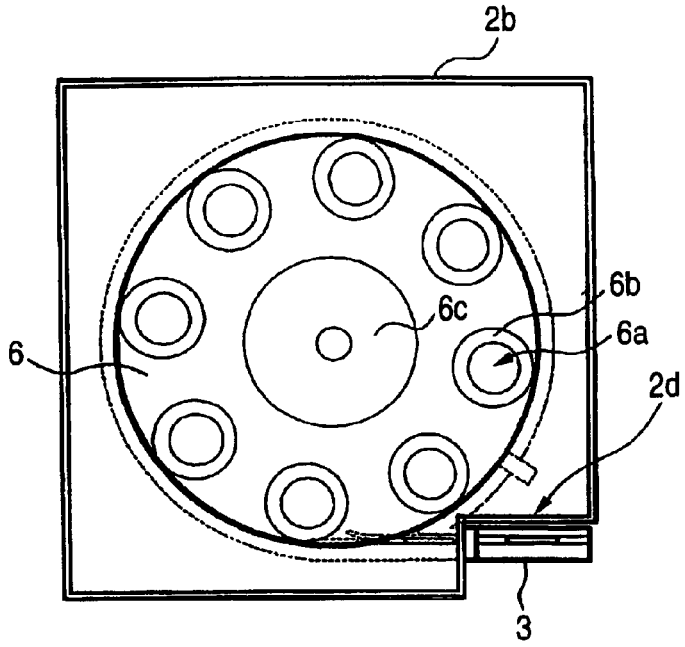
FIG. 12 is a top view showing a positional relationship between a storage section and the escalator.

As illustrated in FIG. 12, a recess 2*d* is formed in the storage section 2*b*. By such a recess 2*d*, the escalator 3 can be oriented upward at a position very close to the gaming token discharging section. Therefore, the gaming token payout apparatus can be made compact, and the recess 2*d* also acts to agitate reserved gaming tokens.

Figure 13:
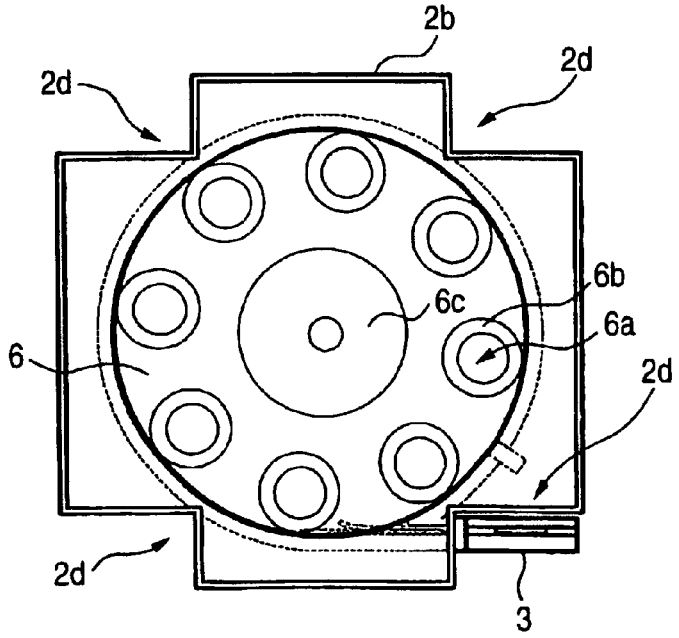
FIG. 13 is a top view showing another example of the storage section.
Figure 14A:
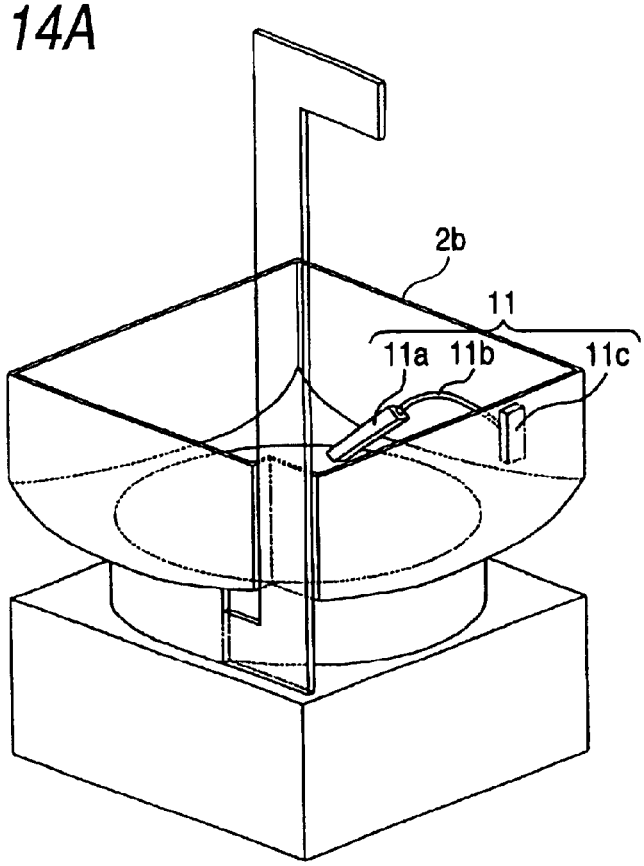
FIG. 14 is a view showing a gaming token payout apparatus equipped with gaming token stabilizer.
Figure 14B:
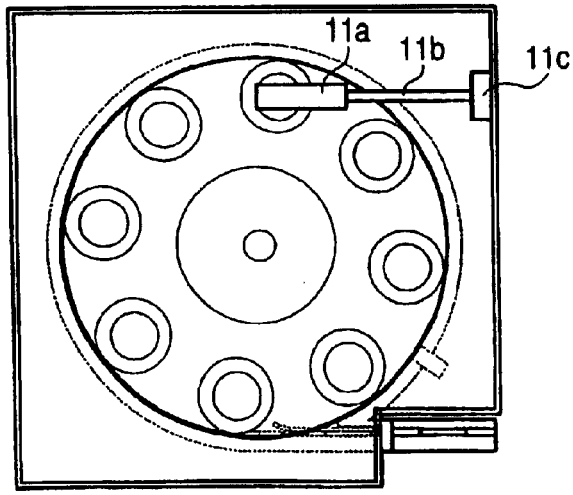

As shown in FIG. 13, the recess 2*d* can be formed in each of the corners of the storage section 2*b*. As shown in FIGS. 14A and 14B, in addition to the configuration set forth, the gaming token payout apparatus can have a gaming token stabilizer. A gaming token stabilizer 11 has a rubber section 11*a* and support sections 11*b*, 11*c*. The support section 11*c* is fastened to the storage section 2*b*. The rubber section 11*a* is placed in the vicinity of a location where the gaming token is supplied from the second hole 6*a* of the disk plate 6 to the first hole 5*a* of the guide plate 5. The gaming token stabilizer 11 has the function of damping vibration of reserved gaming tokens stemming from rotation of the disk plate 6 and facilitating supply of the gaming tokens 10 to the first holes 5*a* and the second holes 6*a*, and enables more accurate payout of gaming tokens.

Figure 15:
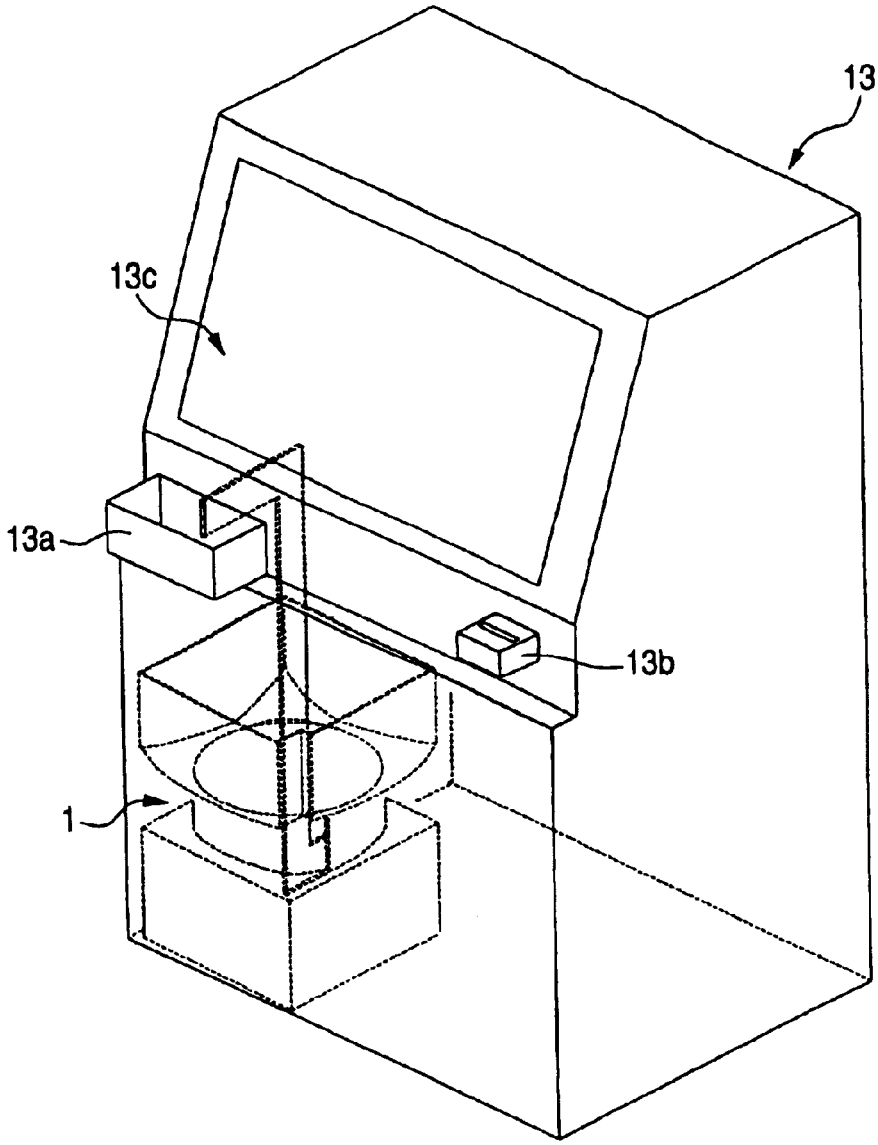
FIG. 15 is a perspective view showing an example in which the gaming token payout apparatus according to the first embodiment is applied to a slot machine.

Next, there is shown an example in which a gaming token payout apparatus according to the embodiment is applied to a gaming machine. FIG. 15 is a perspective view showing an example in which the gaming token payout apparatus according to the first embodiment is applied to a slot machine 13. The slot machine 13 has a payout tray 13*a*, a token insertion slot 13*b*, and a display screen 13*c*. A player plays a game at a height at which the gaming machine display screen 13*c* matches the height of the player's eyes. Here, since the gaming token payout machine 1 according to the embodiment is applied to the slot machine 13, the payout tray 13*a* and the insertion slot 13*b* can be set at a position identical in height with or higher than the position of the insertion slot 13*b*. Therefore, the player can more easily perform operation for taking gaming tokens from the payout tray 13*a* and carrying the gaming tokens to the insertion slot 13*b*. Therefore, there can be prevented dropping of gaming tokens, thereby preventing the player from feeling irritated, or preventing deterioration of entertainment of a game.

Figure 16:
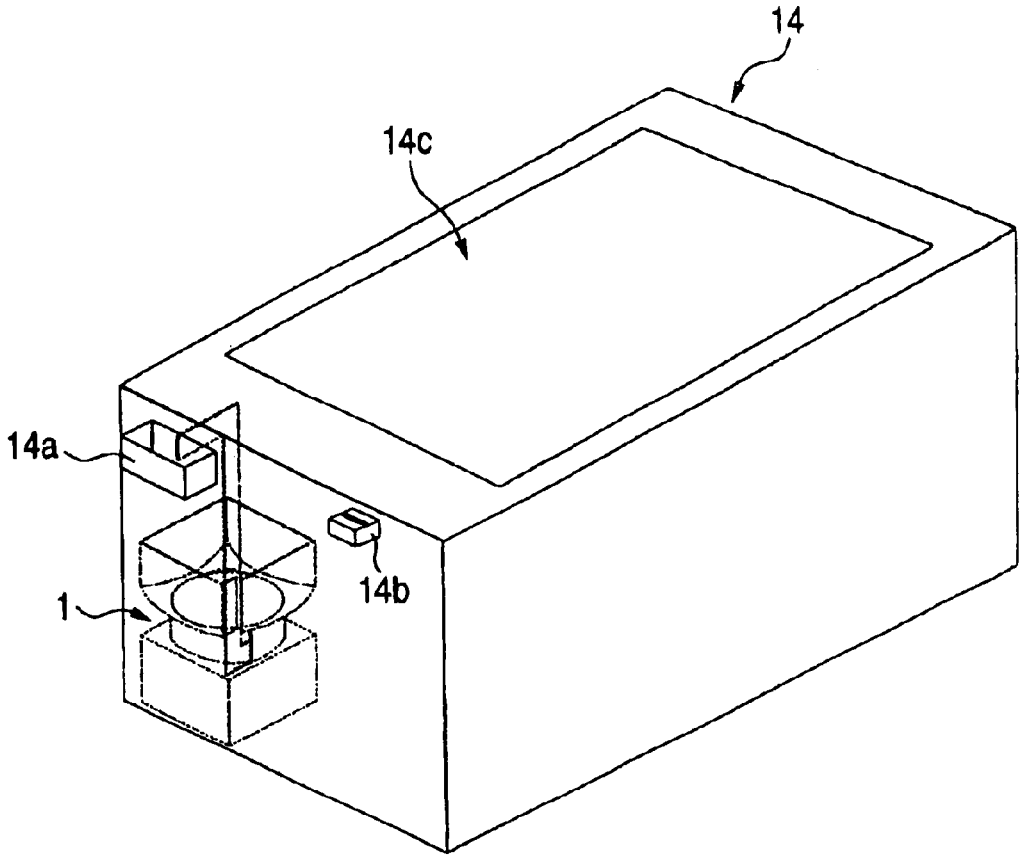
FIG. 16 is a perspective view showing an example in which the gaming token payout apparatus according to the first embodiment is applied to a landscape gaming machine.

FIG. 16 is a perspective view showing an example in which the gaming token payout apparatus according to the first embodiment is applied to a landscape gaming machine. A gaming machine 14 has a payout tray 14*a*, a token insertion slot 14*b*, and a display screen 14*c*. The player plays a game while viewing the display screen 14*c* and standing in front of the gaming machine 14. Here, since the gaming token payout apparatus 1 of the embodiment is applied to the gaming machine 14, the payout tray 14*a* can be placed in an upper part of the gaming machine 14. Further, the payout tray 14*a* can be placed at a position identical in height with or higher than the insertion slot 14*b*. Therefore, the player does not need to assume a crouching posture while taking gaming tokens and can take gaming tokens from the payout tray 14*a* while standing. Since the payout tray 14*a* and the insertion slot 14*b* are located close to each other, the player can more easily perform an action for inserting gaming coins. Therefore, dropping of gaming tokens is inhibited, and the player can be prevented from feeling irritated and enjoy the entertainment of a game.

Figure 17:
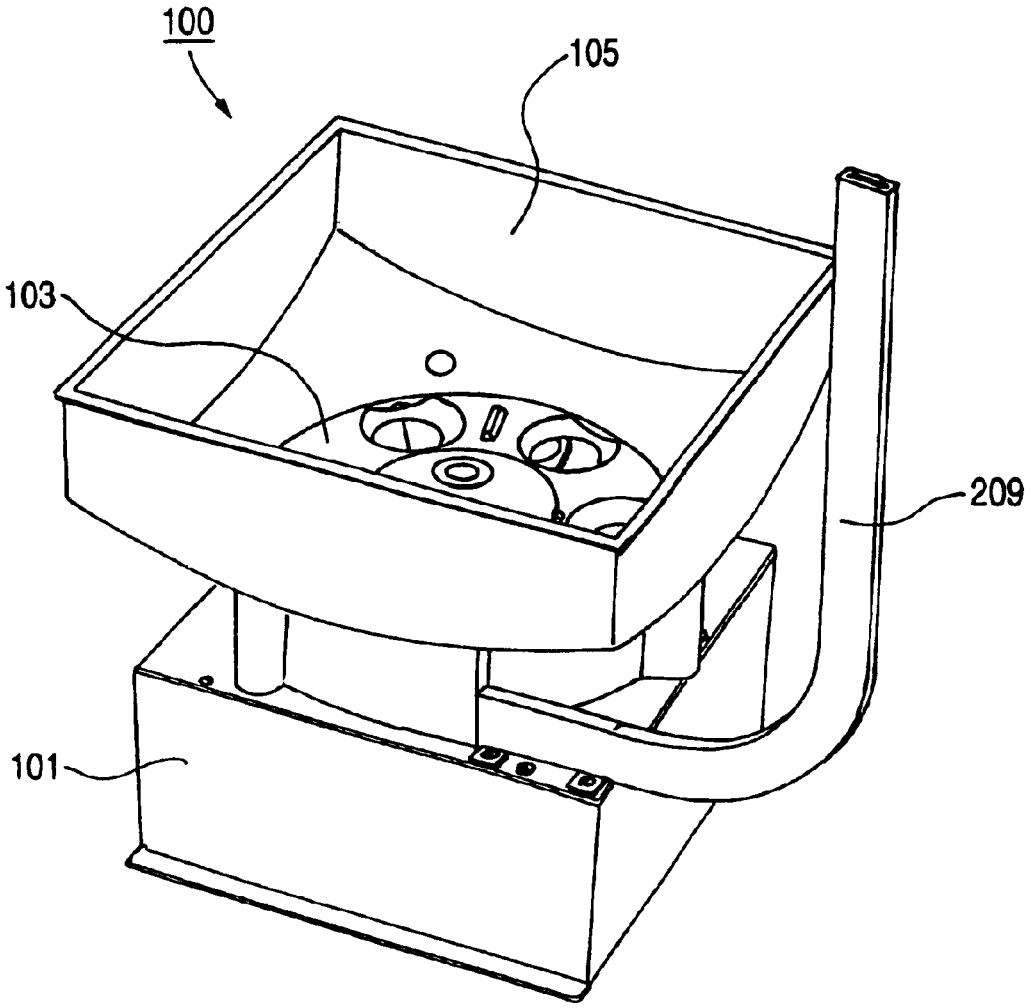
FIG. 17 is a perspective view of a gaming token payout apparatus according to a second embodiment of the invention.
Figure 18:
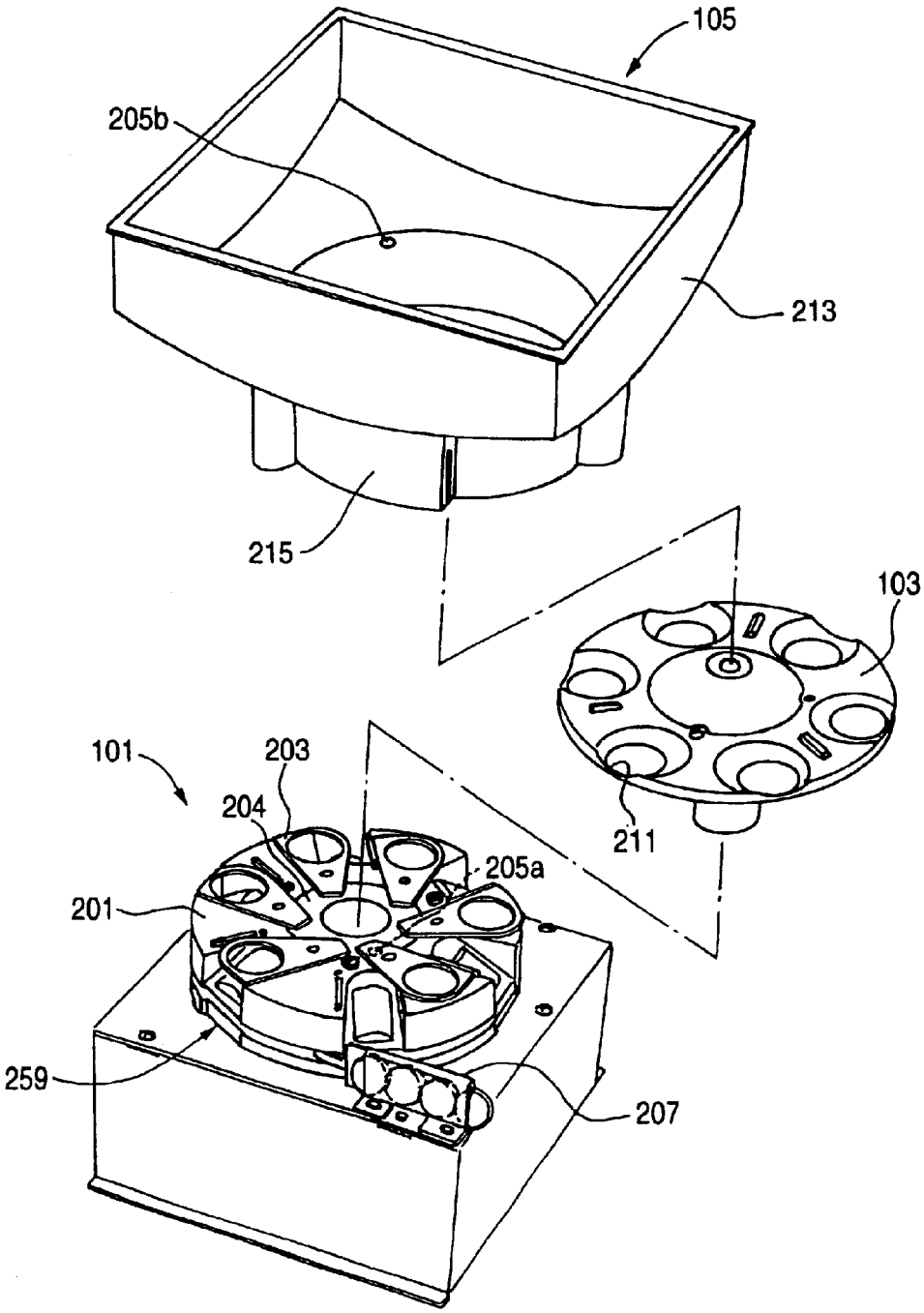
FIG. 18 is an exploded perspective view of the gaming token payout apparatus according to the second embodiment.

A gaming token payout apparatus according to a second embodiment pays out gaming tokens (coins) used in a slot machine or a gaming machine. As illustrated in FIGS. 17 and 18, the gaming token payout apparatus is equipped with a base 101, a disk plate 103, and a hopper 105.

The base 101 has a rotary cylinder 201; six guide plates 203; and a discharging section 207. The rotary cylinder 201 turns as a result of driving action of a motor, whereby a gaming token is paid by way of the discharging section 207. As shown in FIG. 17, the discharging section 207 is equipped with an escalator 209 through which a paid gaming token is transported upward. A ring-shaped fixing member 204 is provided at the inner radius of the rotary cylinder 201, and a magnet 205*a* is provided on the top face of the fixing member 204.

The disk plate 103 constitutes a bottom section of the hopper 105, which will be described later. Six holes 211, which are slightly larger than a gaming token to such an extent as to be able to accept a gaming token, are formed in the disk plate 103. The hopper 105 is designed for storing gaming tokens and comprises a bucket 213, and a cylinder cover 215 which serves as an outer peripheral wall of the rotary cylinder 201 provided in the base 101. Embedded in the cylinder cover 215 is a magnet 205*b* for attracting the outer edges of the guide plates 203 provided in the base 101.

Constituent elements of the gaming token payout apparatus according to the present embodiment and detailed operations thereof will now be described.

Figure 19:
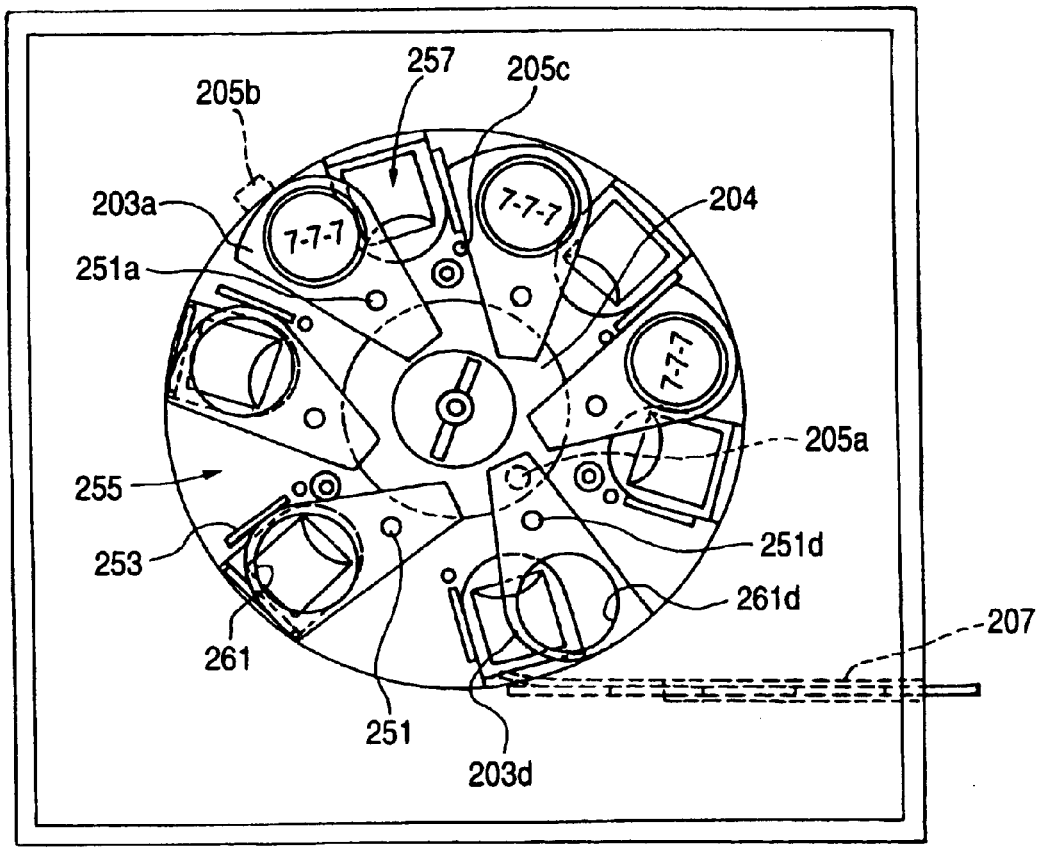
FIG. 19 is a top view of the gaming token payout apparatus according to the second embodiment when a cover has been removed.

First, the base 101 will be described by reference to FIGS. 18 and 19. As shown in FIG. 19, six projections 251 serving as pivotal shafts of the respective guide plates 203 are circularly provided on the top face of the rotary cylinder 201 of the base 101 at fixed intervals. The guide plates 203, which will be described later, are pivotable about the respective projections 251. In order to limit the range of pivotal movement to a predetermined range, six limiters 253 are circularly arranged at fixed intervals.

The six guide plates 203, formed from magnetic material, are disposed on the top face of the rotary cylinder 201. Each of the guide plates 203 is formed with two circular holes; namely, a larger hole 261 and a smaller hole 271, are formed in the guide plate 203. The smaller hole (hereinafter called a "shaft hole") 271 is formed at a position close to an inner side, and the projections 251 provided on the top face of the rotary cylinder 201 are fitted into the corresponding shaft holes 271 of the guide plates 203. In contrast, the larger hole (hereinafter called a "token receiving hole") 261 is formed at a position close to an outer side of the guide plate 203. The larger hole 261 can hold one gaming token therein.

The top face of the rotary cylinder 201 comprises a flat section 255 on which gaming tokens are disposed, and slopes 257 by way of which the gaming tokens placed on the flat section 255 move and drop to an outer periphery of the rotary cylinder 201 in a sliding manner. As shown in FIG. 18, indentations 259, each being substantially equal to the thickness of one gaming token, are formed at positions on the side face of the rotary cylinder 201 which correspond to the locations of the slopes 257.

A gaming token whose face is supported by the flat section 255 moves to the slope 257 by pivotal movement of the guide plate 203. When the gaming token has slid and dropped into the token-groove 259 formed in the side face of the rotary cylinder 201, the gaming token is brought into an orientation perpendicular to the radial direction of the rotary cylinder 201 (i.e., the peripheral face of the gaming token is supported). In association with rotation of the rotary cylinder 201, the gaming token in an upright position moves along the cylinder cover 215 of the hopper 105. When the gaming token whose peripheral face is supported has moved along the cylinder cover 215 and reached a position where the side face of the base 101 is engaged with one end of the discharging section 207, the gaming token departs from the token-groove 259 in its present orientation and is delivered to the discharging section 207. The thus-delivered gaming token 207 is pushed by a subsequently-paid gaming token. As shown in FIG. 18, the gaming token is finally paid out as if being pushed by way of the gaming token payout port of the discharging section 207.

As mentioned above, each of the guide plates 203 pivots about the corresponding projection 251. The pivotable range of the guide plate 203 is limited by the corresponding limiter 253 provided on the flat section 255. As a result of pivotal movement of the guide plate 203, the guide plate 203 shifts from a state in which the token receiving hole 261 is situated on the flat section 255 of the rotary cylinder 201 (hereinafter called a "first state") to a state in which the token receiving hole 261 is situated above the slope 257 (hereinafter called a "second state"). Conversely, the guide plate 203 can shift from the state in which the token receiving hole 261 is situated above the slope 257 (i.e., the second state) to the state in which the token receiving hole 261 is situated on the flat section 255 (i.e., the first state).

By reference to FIGS. 19 and 20, there will now be described in detail operation of the gaming token payout apparatus to be performed when the guide plate 203 shifts from the first state (in which the token receiving hole 261 of the guide plate 203 is situated on the flat section 255) to the second state (in which the token receiving hole 261 is situated above the slope 257).

FIG. 19 particularly shows a state in which the guide plate 203*a* of interest is in the first state. FIG. 20 particularly shows the guide plate 203*a* of interest is in the second state. Reference numeral 205*b* provided in FIGS. 3 and 4 designates a magnet embedded in the cylinder cover 215 of the hopper 105. When the guide plate 203 approaches the magnet 205*b* as a result of rotation of the rotary cylinder 201, the magnet 205*b* attracts the outer peripheral edge section of the guide plate 203.

Magnets 205*c* are provided on the flat section 255 for preventing droppage of a gaming token housed in the token receiving hole 261, which would otherwise be caused when the guide plate 203*a* shifts from the first state to the second state for reasons of vibration before being attracted by the magnet 205*b*. The magnet 205*c* holds the guide plate 203*a* in the first state and has magnetic force weaker than that of the magnet 205*b*. Consequently, when the guide plate 203*a* is attracted and rotated by the magnet 205*b*, attracting action of the magnet 203*c* is overcome.

As shown in FIG. 19, as a result of the rotary cylinder 201 rotating, the guide plate 203*a* held in the state by the magnet 205*c* approaches the magnet 205*b*, whereby the outer peripheral edge of the guide plate 203*a* is attracted by the magnet 205*b*. Since the rotary cylinder 201 continues rotating without interruption, the guide plate 203*a* pivots about the projection 251*a* while being attracted by the magnet 205*b*. As the rotary cylinder 201 rotates, the guide plate 203*a* shifts from the first state to the second state.

Consequently, the gaming token housed in the token receiving hole 261*a* moves from the flat section 255 of the rotary cylinder 201 to the slope 257. As shown in FIG. 20, when the guide plate 203*a* has entered the second state, the gaming token held in the token receiving hole 261*a* drops along the slope 257 of the rotary cylinder 201 in a sliding manner. The gaming token is then held in an orientation perpendicular to the radial direction of the rotary cylinder 201, by the token-groove 259 formed in the side face of the rotary cylinder 201.

As shown in FIG. 17, the disk plate 103 in which the six holes 211 slightly larger than a gaming token are formed is provided in a position above the base 101. By combination of the holes 211 with the disk plate 103, the holes 211 are situated immediately above the flat section 255 of the rotary cylinder 201. When the guide plate 203 is in the second state (i.e., the state in which the token receiving holes 261 are situated above the corresponding slopes 257), no positional match exists between the hole 211 of the disk plate 103 and the token receiving hole 261 of the guide plate 203. Hence, even when the gaming token is held in the hole 211 of the disk plate 103, that gaming token is not brought in the token receiving hole 261. Consequently, in order to bring a gaming token into the token receiving hole 261 of the guide plate 203, the guide plate 203 in the second state must be returned to the first state in the next stage.

By reference to FIGS. 19 and 20, there will now be described in detail the operation of the gaming token payout apparatus to be performed when the guide plate 203 shifts from the second state (in which the token receiving hole 261 of the guide plate 203 is situated above the slope 257 of the rotary cylinder 201) to the first state (in which the token receiving hole 261 is situated in the flat section 255). In this context, FIG. 19 particularly shows a state in which the guide plate 203*d* of interest is in the second state. FIG. 20 particularly shows the guide plate 203*d* of interest is in the first state.

The magnet 205*a* provided on the top face of the fixing member 204 disposed at the inner radius of the rotary cylinder 201. As shown in FIG. 19, when the guide plate 203*d* in the second state approaches the magnet 205*a* as a result of rotation of the rotary cylinder 201, the magnet 205*a* attracts the reverse side of a portion of the inner side of the guide plate 203. Since the rotary cylinder 201 continues rotating without interruption, the guide plate 203*d* pivots about the projection 251*d* while being attracted by the magnet 205*a*.

Figure 20:
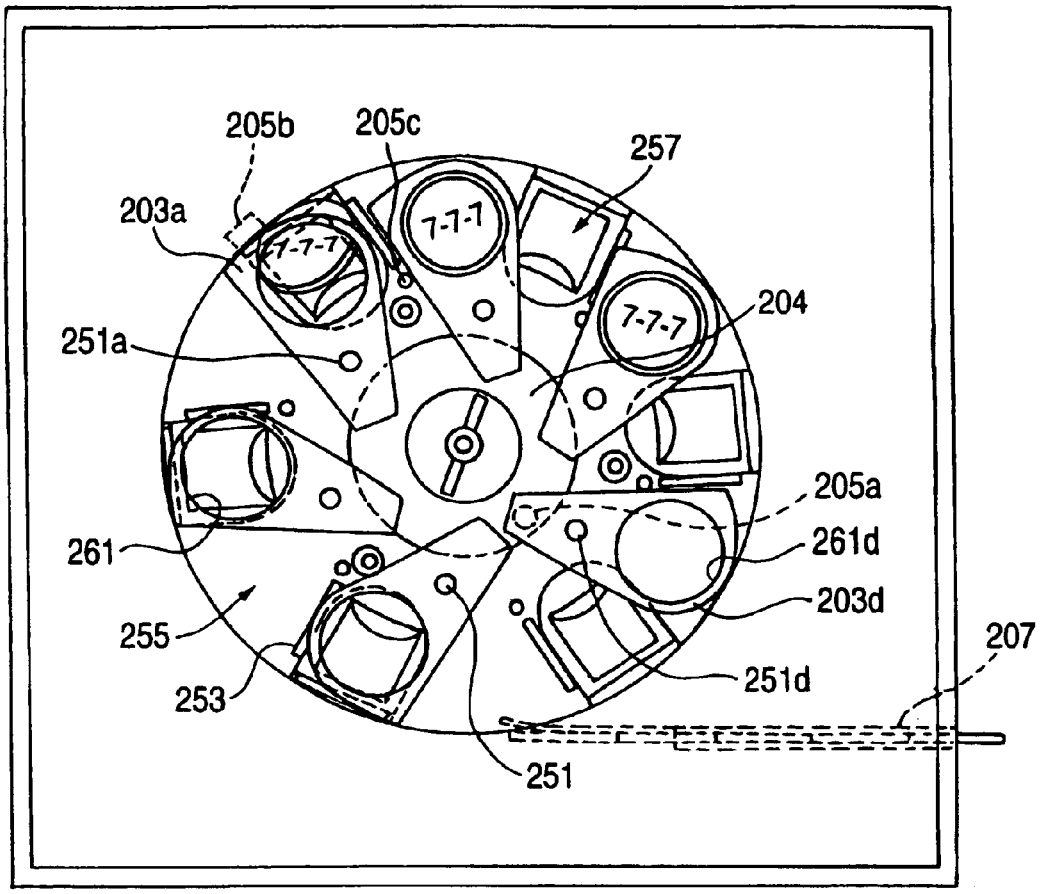
FIG. 20 is a top view of the gaming token payout apparatus according to the second embodiment when the cover is removed from the apparatus.

As the rotary cylinder 201 rotates, the guide plate 203*d* shifts from the second state to the first state as shown in FIG. 20. Since a positional match exists between the token receiving hole 261*d* of the guide plate 203*d* that has returned to the first state and a corresponding hole formed in the disk plate 103, the gaming token housed in the hole of the disk plate 103 is housed in the token receiving hole 261 of the guide plate 203.

As has been described, in the gaming token payout apparatus according to the embodiment, when the guide plate 203 shifts from the first state to the second state as a result of rotation of the rotary cylinder 201, the gaming token whose main face is supported by the flat section 255 of the rotary cylinder 201 (i.e., in an orientation parallel to the radial direction of the rotary cylinder 201) moves to the slope 257 and slips and drops to the token-groove 259. As a result, the peripheral face of the gaming token is supported (i.e., the gaming token is brought into an orientation perpendicular to the radial direction of the rotary cylinder 201). The gaming token that has dropped and slipped to the token-groove 259 moves in its present orientation to the discharging section 207 in association with rotation of the rotary cylinder 201.

Consequently, the gaming tokens whose peripheral faces are supported are placed in a line along the discharging section 207. When a new gaming token moves from the token-groove 259 to the discharging section 207, the gaming token located closest to an exit of the discharging section 207 is sequentially paid out while the peripheral face thereof is supported; that is, while remaining in an orientation perpendicular to the rotary cylinder 201. The thus-paid gaming tokens are transported upward in the form of a line through the inside of the escalator 209, such as that shown in FIG. 17, connected to the exit of the discharging section 207.

Figure 21:
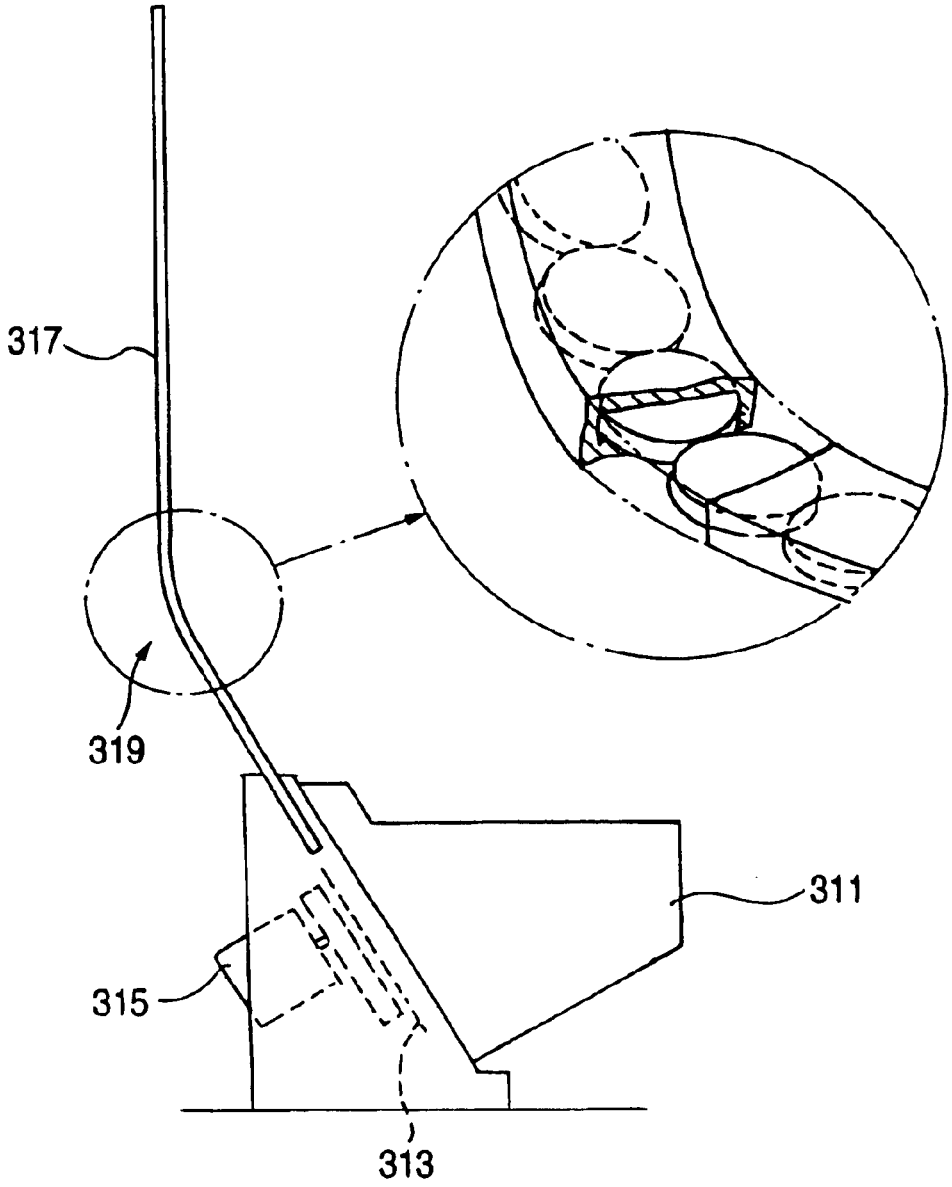
FIG. 21 is a descriptive view showing an example of a related-art gaming token payout apparatus and the manner in which gaming tokens are paid.

In a case where a curved section exists in a part of the escalator 209, a state, in which the gaming tokens are transported through the inside of the escalator 209 by way of a curved section while their peripheral faces are supported, as in the case of the present embodiment, is compared with another state, in which gaming tokens go through a curved section while the main faces of the gaming tokens are supported and remain in slidable contact with an interior face of the escalator 209, as in the case shown in FIG. 21. The friction which develops between the gaming token and the escalator 209 in the latter state is greater than that developing in the former state. In light of the ease of passage of a gaming token through the curved section, the present embodiment, in which the peripheral face of the gaming token is supported, yields an advantage of smooth transportation of gaming tokens without involvement of jamming.

In a case where gaming tokens advance through the inside of the escalator 209 while the main faces of the gaming tokens are supported, as in the case of the related-art gaming token payout apparatus, the radius of curvature of the curved section must be set to a value sufficiently greater than the radius of the gaming token. As in the case of the embodiment, in a case where the gaming tokens advance through the inside of the escalator 209 while the peripheral faces of the gaming tokens are supported, the radius of curvature of the curved section can be made smaller, thereby enabling shortening of the escalator 209. Consequently, the space occupied by the escalator 209 can be made small.

There is no necessity of disposing the entirety of the gaming token payout apparatus; that is, the base 101 including a motor and the hopper 105, at angles with respect to a horizontal direction; the gaming token payout apparatus can be utilized in a horizontal position. Hence, a space within a gaming machine, such as a slot machine, occupied by the gaming token payout machine can be utilized effectively.

An agitation rod (not shown) for agitating the gaming tokens stored in the hopper 105 may be provided. Although a barrel-shaped protuberance is provided on the face of the slope 257 of the rotary cylinder 201 shown in FIGS. 3 and 4, the face of the slope 257 may be made flat without use of such a protuberance. Although the present embodiment has described the gaming token payout apparatus as a machine for paying out gaming tokens in a slot machine or a gaming machine, the present invention may be utilized as an apparatus for paying out coins in an ordinary money changer or an automatic vending machine.

In the present embodiment, the guide plates 203 are rotated by the magnets 205*a*, 205*b*. However, in a case where the gaming tokens are made of magnetic material, the magnets 205*a*, 205*b* may cause a problem. In such a case, a stationary piece is provided in place of magnets. A stationary piece may be engaged with the guide plate 203, thereby rotating the guide plate 203. For example, stationary pieces may be provided in lieu of the magnets 205*a*, 205*b* (while the magnet 205*c* remains in its present form). Alternatively, a stationary piece may be provided in place of the magnet 205*a*. Further, a spring (e.g., a compression spring, a tensile spring, or a torsion spring) may be provided in lieu of the magnet 205*c*.

The invention realized by the present inventors has been described specifically. However, the invention is not limited to the above-described embodiments and is susceptible to various modifications falling within the scope of the invention.

For example, the embodiments have exemplified a magnet and fixed pins for the mechanism for moving the guide plates 5. However, as the mechanism for moving the holes of the guide plates 5 toward the pits 4*b*, there can also be adopted a mechanism of moving the holes of the guide plates 5 toward the pits 4*b* by fixed pins provided on the outer peripheral section of the rotary cylinder 4. In this case, the guide plates 5 need not be formed from magnetic material. Further, as the mechanism for moving the holes of the guide plates 5 toward the flat section, there can also be adopted a mechanism using a magnet. These mechanisms using fixed pins or a magnet can be used in arbitrary combination.

Although the embodiments have exemplified the rotary cylinder 4, a columnar body may be employed. In this case, the space required for placing the fixing member 7 is eliminated. However, there may be employed, for example, a structure wherein a concentric slit is formed in the disk plate 6, and a probe-like member which is fixedly disposed against rotational driving action is inserted into the slit from above, thereby causing the probe-like member to act in the same manner as does the pin 7*a*.

The embodiments have described a case where the gaming tokens 10 are transported in a vertical direction. In other words, the gaming token payout port is placed at a position substantially above the gaming token payout apparatus. However, the invention can also be applied to a case where gaming tokens are to be transported horizontally or downward. According to the invention, gaming tokens are transported by utilization of rotating actions of the gaming tokens. Hence, transportation of gaming tokens involves little mechanical resistance. For this reason, gaming tokens can be transported arbitrarily in a direction in which transportation of gaming tokens can be ensured (i.e., transportation of gaming tokens in a horizontal direction, an oblique direction, a vertical direction, or the like). Since transportation of gaming tokens in such an arbitrary direction can be embodied, less restrictions are imposed on the positional relationship between the gaming token payout apparatus and the gaming token payout port. There is yielded an advantage of increasing a degree of design freedom of a gaming machine or entertainment apparatus by utilization of the gaming token payout apparatus according to the invention. Further, less restrictions are imposed on the position of the gaming token payout port (i.e., the position of the gaming token payout tray). Therefore, a gaming token count sensor can be disposed at an arbitrary position between the gaming token payout apparatus and the gaming token payout port. Thus, there is also yielded an advantage of easy protection against illegal payout of gaming tokens.

What is claimed is:

1. A gaming token payout apparatus, comprising:

a columnar member, which is rotated about a rotation axis interconnecting a center point of a top face thereof and a center point of a bottom face thereof, the columnar member having an outer peripheral face formed with at least one token-groove; and an outer wall member, which covers the outer peripheral face of the columnar member to form a gap between an inner face of the outer wall member and the token-groove such that a single gaming token in an upright attitude is held therein, wherein the gaming token held in the gap is ejected toward a tangent direction of the outer peripheral face of the columnar member in accordance with a rotary action of the columnar member.

2. The payout apparatus as set forth in claim 1, further comprising a separation plate extending along the tangent direction, wherein an extremity of the separation plate is inserted into a separation groove formed on the outer peripheral face of the columnar member.

3. The payout apparatus as set forth in claim 1, further comprising a transporting member which transports the ejected gaming token in a direction perpendicular to the tangent direction and parallel with the rotation axis.

4. The payout apparatus as set forth in claim 3, wherein:

a transporting path having a rectangular cross section is formed in the transporting member is provided with a transporting path therein;

the rectangular cross section includes a first side having a length L1 and a second side having a length L2; and the transporting path satisfies the following relationships:

$$d<L1<1.5d$$

$$t<L2<1.5t$$

where d represents a diameter of the gaming token and t represents a thickness of the gaming token.

5. A gaming token payout apparatus, comprising:

a columnar member, which is rotated about a rotation axis interconnecting a center point of a top face thereof and a center point of a bottom face thereof, the columnar member having an outer peripheral face formed with at least one token-groove and having a top face formed with at least one pit situated so as to be associated with the token-groove; and an outer wall member, which covers the outer peripheral face of the columnar member to form a gap between an inner face of the outer wall member and the token-groove such that a single gaming token in an upright attitude is held therein, wherein a single gaming token in a non-upright attitude falls into the pit and goes down to the gap.

6. The payout apparatus as set forth in claim 5, wherein a bottom portion of the pit is provided as a slope extending toward an upper end of the token-groove.

7. The payout apparatus as set forth in claim 6, wherein an inclination angle of the slope is 30° or more.

8. A gaming token payout apparatus, comprising:

a columnar member, which is rotated about a rotation axis interconnecting a center point of a top face thereof and a center point of a bottom face thereof, the columnar member having a top face formed with a flat section and at least one pit; and at least one guide plate, which is provided on the top face of the columnar member so as to be movable in a direction parallel with the top face, the guide plate formed with a hole having a dimension capable of housing a single gaming token therein, wherein the gaming token is held in the hole when the guide plate is situated in a first position which is above the flat section and falls into the pit when the guide plate is situated in a second position which is above the pit.

9. The payout apparatus as set forth in claim 8, wherein the guide plate is pivotably supported on the top face of the columnar member.

10. The payout apparatus as set forth in claim 8, further comprising:

an outer wall member, which covers the outer peripheral face of the columnar member, and a magnetic field generator, fixed on the outer wall member, wherein the guide plate member is made of a ferromagnetic material so that the guide plate is moved from the first position to the second position by an attractive force generated by the magnetic field generator, while the columnar member is rotated.

11. The payout apparatus as set forth in claim 8, further comprising:

an outer wall member, which covers the outer peripheral face of the columnar member, and a pin member, fixed on the outer wall member, wherein the guide plate comes into contact with the pin member in accordance with a rotary action of the columnar member, so that the guide plate is moved from the first position to the second position.

12. A gaming token payout apparatus, comprising:

a columnar member, which is rotated about a rotation axis interconnecting a center point of a top face thereof and a center point of a bottom face thereof;

at least one guide plate, which is provided on a top face of the columnar member so as to be movable in a direction parallel with the top face, the guide plate formed with a first hole having a dimension capable of housing therein a single gaming token in a horizontal attitude; and a disk plate, provided above the guide plate and rotated in cooperation with the columnar member, the disk plate formed with at least one second hole having a dimension capable of housing therein a single gaming token in a horizontal attitude, wherein the guide plate is moved to a first position below the second hole in accordance with a rotary action of the columnar member so that the gaming token housed within the second hole falls into the first hole.

13. The payout apparatus as set forth in claim 12, further comprising:

a support shaft which pivotably support the guide plate on the top face of the columnar member; and a magnetic field generator, fixed at a position between the rotary axis and the support shaft, wherein the guide plate member is made of a ferromagnetic material so that the guide plate is moved to the first position by an attractive force generated by the magnetic field generator, while the columnar member is rotated.

14. The payout apparatus as set forth in claim 12, further comprising:

a support shaft which pivotably support the guide plate on the top face of the columnar member; and a pin member, fixed at a position between the rotary axis and the support shaft, wherein the guide plate comes into contact with the pin member in accordance with a rotary action of the columnar member, so that the guide plate is moved to the first position.

15. The payout apparatus as set forth in claim 12, wherein:

the top face of the columnar member is formed with at least one pit;

a maximum length L3 of an open space viewed from the first hole when the guide plate is situated in the first position satisfies the following requirement:

$$0 \leq L3 < 0.8d$$

where d represents a diameter of the gaming token.

16. The payout apparatus as set forth in claim 12, further comprising a bucket section which reserves gaming tokens therein, wherein the bucket section includes either one of the second hole and a protrusion for agitating the gaming tokens.

17. A gaming token payout apparatus, comprising:

a columnar member, which is rotated about a rotation axis interconnecting a center point of a top face thereof and a center point of a bottom face thereof;

an outer wall member, which covers the outer peripheral face of the columnar member;

a disk plate, provided above the columnar member and rotated in cooperation with the columnar member, the disk plate formed with at least one hole having a dimension capable of housing therein a single gaming token in a horizontal attitude; and a bucket section which reserves gaming tokens therein, the bucket section provided above the outer wall member and integrated with the outer wall member.

18. The payout apparatus as set forth in claim 17, further comprising a transporting member which transports gaming tokens ejected from the columnar member in a direction parallel with the rotation axis, wherein:

the bucket member having a horizontal cross sectional shape including a recessed portion; and the transporting member extends through the recessed portion.

19. A gaming token payout apparatus, comprising:

a columnar member, which is rotated about a rotation axis interconnecting a center point of a top face thereof and a center point of a bottom face thereof, the columnar member having an outer peripheral face formed with at least one token-groove and having a top face formed with at least one pit situated so as to be associated with the token-groove;

an outer wall member, which covers the outer peripheral face of the columnar member to form a gap between an inner face of the outer wall member and the token-groove such that a single gaming token in an upright attitude is held therein;

at least one guide plate, which is provided on a top face of the columnar member so as to be movable in a direction parallel with the top face, the guide plate formed with a first hole having a dimension capable of housing therein a single gaming token in a horizontal attitude; and a disk plate, provided above the guide plate and rotated in cooperation with the columnar member, the disk plate formed with at least one second hole having a dimension capable of housing therein a single gaming token, wherein:

the guide plate is moved to a first position below the second hole in accordance with a rotary action of the columnar member so that the gaming token housed within the second hole falls into the first hole;

the gaming token held in the first hole is fell into the pit and goes down to the gap, when the guide plate situates a third position which is above the pit; and the gaming token held in the gap is ejected toward a tangent direction of an outer peripheral face of the columnar member in accordance with the rotary action of the columnar member.

20. The payout apparatus as set forth in claim 19, further comprising a separation plate extending along the tangent direction, wherein an extremity of the separation plate is inserted into a separation groove formed on the outer peripheral face of the columnar member.

21. The payout apparatus as set forth in claim 19, further comprising a transporting member which transports the ejected gaming token in a direction perpendicular to the tangent direction and parallel with the rotation axis.

22. The payout apparatus as set forth in claim 21, further comprising a bucket section which reserves gaming tokens therein, the bucket section provided above the outer wall member and integrated with the outer wall member, the bucket member having a horizontal cross sectional shape including a recessed portion, wherein the transporting member extends through the recessed portion.

23. A gaming token payout apparatus for paying out a gaming token to a player, comprising:

a rotary cylinder member, including:

a top face, having a flat section and a slope entrance section;

a side face, having a slope exit section;

a slope, connecting the slope entrance section and the slope exit section, on which the gaming token slides down;

a token holder, formed with the slope exit section, which holds the gaming token slid down on the slope such that an attitude of the gaming token is made parallel with the side face; and a discharging section into which the gaming token held in the token holder enters in accordance with a rotation of the rotary cylinder member, while keeping the attitude of the gaming token.

24. The gaming token payout apparatus as set forth in claim 23, further comprising a guide plate member, formed with a token receiving hole which houses the gaming token therein, the guide plate member provided on the flat section so as to be pivotable between a first position at which the token receiving hole faces the flat section and a second position at which the token receiving hole faces the slope entrance section.

25. The gaming token payout apparatus as set forth in claim 24, further comprising a first mover which forcibly moves the guide plate member from the first position to the second position in accordance with the rotation of the rotary cylinder member.

26. The gaming token payout apparatus as set forth in claim 25, further comprising a second mover which forcibly moves the guide plate member from the second position to the first position in accordance with the rotation of the rotary cylinder member.

27. The gaming token payout apparatus as set forth in claim 25, further comprising a retainer which retains the guide plate member at the first position before the first mover forcibly moves the guide plate member to the second position.

28. The gaming token payout apparatus as set forth in claim 25, wherein the guide plate member is made of a magnetic material, and the first mover is a first magnet which attracts the guide plate member with a first magnetic force.

29. The gaming token payout apparatus as set forth in claim 26, wherein the guide plate member is made of a magnetic material, and the second mover is a second magnet which attracts the guide plate member with a second magnetic force.

30. The gaming token payout apparatus as set forth in claim 28, further comprising a retainer which retains the guide plate member at the first position with a force weaker than the first magnetic force, before the first magnet forcibly moves the guide plate member to the second position.

31. The gaming token payout apparatus as set forth in claim 23, wherein the gaming token proceeds in the discharging section while being pushed by a gaming token subsequently entered therein to in accordance with the rotation of the rotary cylinder member.

32. The gaming token payout apparatus as set forth in claim 24, further comprising a hopper which contains the gaming token therein, the hopper having a bottom face formed with a hole having a size larger than a diameter of the gaming token, wherein the gaming token contained within the hopper falls into the token receiving hole of the guide plate member through the hole, only when the guide plate member is situated in the first position.

* * * * *